US008146518B2

(12) United States Patent
Eveleth

(10) Patent No.: US 8,146,518 B2
(45) **Date of Patent: *Apr. 3, 2012**

(54) FOLDABLE STOOL OR TABLE

(76) Inventor: Bradley R. Eveleth, Rapid City, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/958,590

(22) Filed: Dec. 2, 2010

(65) Prior Publication Data

US 2011/0067608 A1 Mar. 24, 2011

Related U.S. Application Data

(63) Continuation of application No. 11/681,430, filed on Mar. 2, 2007, now Pat. No. 7,905,184, which is a continuation-in-part of application No. 29/236,509, filed on Aug. 16, 2005, now Pat. No. Des. 566,856.

(51) Int. Cl.
*A47B 3/00* (2006.01)

(52) U.S. Cl. ..... 108/115; 108/124; 297/44

(58) Field of Classification Search ..... 108/115, 108/124, 162, 165, 166, 167, 169, 170, 171, 108/173, 174, 175, 150; 297/42, 44, 461
See application file for complete search history.

(56) References Cited

U.S. PATENT DOCUMENTS

| | | | |
|---|---|---|---|
| 318,298 | A | 5/1885 | Roberts |
| 409,677 | A | 8/1889 | Forman |
| 703,690 | A | 7/1902 | Young |
| 900,552 | A | 10/1908 | Kade |
| 1,263,717 | A | 4/1918 | Stone |
| 1,811,674 | A | 6/1931 | Longley |
| 1,970,196 | A | 8/1934 | Rodemeyer |
| D156,324 | S | 12/1949 | Dastugue |
| D169,461 | S | 4/1953 | Tilley |
| D170,311 | S | 9/1953 | Doherty |
| 3,077,282 | A | 2/1963 | Eggers |
| 3,120,076 | A | 2/1964 | Zuch |
| 3,188,158 | A | 6/1965 | Sanchez |
| 3,232,252 | A | 2/1966 | Nelson |
| 3,673,636 | A | 7/1972 | Ruiz |
| 4,043,277 | A | 8/1977 | Wallace |
| 4,122,638 | A | 10/1978 | O'Brian et al. |
| 4,253,268 | A | 3/1981 | Mayr |
| D265,026 | S | 6/1982 | Macho et al. |
| 4,359,243 | A | 11/1982 | Crutcher |

(Continued)

FOREIGN PATENT DOCUMENTS

CA 114529 3/2007

(Continued)

OTHER PUBLICATIONS

Photos of Turtle Stool, dated Aug. 14, 2001, pp. 1-3.

(Continued)

*Primary Examiner* — Jose V Chen
(74) *Attorney, Agent, or Firm* — Sheridan Ross P.C.

(57) ABSTRACT

A foldable stool or table having hinges comprises a plurality of support members. In one embodiment, a foldable device comprises three legs. In another embodiment, the foldable stool or table comprises two foldable support members and two non-foldable support members. Relative to the top and bottom of the device one or more intermediately located steps or shelves, wherein the steps or shelves are located along at least one of the non-foldable support members, may be included. The one or more intermediately located steps or shelves may be forwardly-offset relative to a front surface of the non-foldable support members. A method of using the stool is also provided.

17 Claims, 20 Drawing Sheets

U.S. PATENT DOCUMENTS

| | | | |
|---|---|---|---|
| 4,383,488 | A | 5/1983 | Macho et al. |
| 4,389,946 | A | 6/1983 | Hwang |
| 4,437,413 | A | 3/1984 | O'Brian et al. |
| 4,533,179 | A | 8/1985 | Nichols et al. |
| 4,630,861 | A | 12/1986 | Henschel |
| 4,648,658 | A | 3/1987 | Calco |
| 4,807,329 | A | 2/1989 | Mossalgue |
| 4,809,619 | A | 3/1989 | Piretti |
| 4,951,996 | A | 8/1990 | Shannon |
| 5,361,456 | A | 11/1994 | Newby, Sr. |
| 5,382,081 | A | 1/1995 | Henry |
| 5,697,669 | A | 12/1997 | Yemini |
| 5,697,675 | A | 12/1997 | DeWitt et al. |
| 5,845,366 | A | 12/1998 | Kuroda |
| 5,940,934 | A | 8/1999 | Turner |
| D414,566 | S | 9/1999 | Gibson et al. |
| 6,089,522 | A | 7/2000 | Haslem et al. |
| D441,094 | S | 4/2001 | Hawe |
| 6,257,153 | B1 | 7/2001 | Portugal |
| D447,572 | S | 9/2001 | Rosko |
| D448,091 | S | 9/2001 | Eveleth |
| D449,386 | S | 10/2001 | Cheris et al. |
| D460,566 | S | 7/2002 | Henschel et al. |
| 6,568,506 | B1 | 5/2003 | Donnalley |
| D501,683 | S | 2/2005 | Hernandez et al. |
| D553,372 | S | 10/2007 | Henschel |
| D554,875 | S | 11/2007 | Emert |
| D566,856 | S | 4/2008 | Eveleth |
| D577,833 | S | 9/2008 | Eveleth |
| D579,680 | S | 11/2008 | Emert |
| D586,923 | S | 2/2009 | Eveleth |
| 7,905,184 | B2 | 3/2011 | Eveleth |

FOREIGN PATENT DOCUMENTS

| | | |
|---|---|---|
| GB | 397413 | 8/1933 |
| GB | 397954 | 9/1933 |
| GB | 597003 | 1/1948 |

OTHER PUBLICATIONS

Official Action for U.S. Appl. No. 11/681,430, mailed Sep. 9, 2009 Restriction Requirement.

Official Action for U.S. Appl. No. 11/681,430, mailed Jan. 28, 2010.

Notice of Allowance for U.S. Appl. No. 11/681,430, mailed Aug. 4, 2010.

FOLDABLE STOOL OR TABLE

CROSS REFERENCE TO RELATED APPLICATIONS

The present application is a continuation of U.S. patent Ser. No. 11/681,430, filed Mar. 2, 2007, which is a continuation-in-part application of U.S. Design Pat. application No. 29/236,509, filed Aug. 16, 2005, now U.S. Pat. No. D566,856, entitled "Folding Stool With Step," the entire disclosures of which are incorporated by reference herein.

FIELD OF THE INVENTION

The present invention generally relates to an apparatus to sit upon or support an object, and more specifically to portable and foldable stools and tables.

BACKGROUND OF THE INVENTION

There are commercial and residential uses for stools, step ladders, and portable tables of varying sizes. Problems inherent to all of these types of devices are storage, stability, and manufacturing costs, as well as "pinch points" associated with folding the devices.

A compact area for storing a stool, step ladder, or portable table is critically important to its utility. The need to minimize the device's size for storage purposes often results in the stool becoming unstable and unsafe for use. While there is an ever present demand to lower manufacturing costs, the structural integrity of the apparatus should not be compromised. Thus, there is a need for a cost-effective, lightweight, foldable stool, table or step ladder that is stable and can be stored in a compact manner.

Stools, tables and step ladders are known in the art that have three and four points of support and the ability to fold. The problem with most three-legged stools, however, is that they do not fold, making them difficult to store. With some existing three-legged stools, the seat is removable, and thus it can become lost during transit. In addition, some seats can become detached during use if not originally positioned properly, which could result in serious injury for the user. Thus, there is a need for a compact, foldable stool that uses three members for support and has a seat that remains attached and also folds to minimize storage. Furthermore, there is a need for a foldable stool or table which eliminates pinch points to avoid injury to fingers and other appendages during folding or unfolding.

Four-legged stools of the prior art are generally expensive to manufacture and are quite bulky, even in a folded or collapsed state. In addition, foldable stools with steps are typically bulkier and less stable. Thus, there is a need for a relatively compact four-legged stool that provides one or more steps and is relatively light weight and easily portable.

There is also a need for providing a portable table that provides a relatively stable base and is easily collapsible. In addition, there is a need for portable table that provides handy storage for items such as cups or utensils.

SUMMARY OF THE INVENTION

It is thus one aspect of the present invention to provide a cost-effective, lightweight, portable stool. In one embodiment, this is accomplished by using a foldable, three-legged design that minimizes materials, reduces manufacturing costs, and is both lightweight and portable.

It is another aspect of the present invention to provide a stable stool, which can be opened and closed between a first position of use and a second position of storage. In one embodiment, the stool has three support members that are hingedly interconnected, two that are rigid and a third that is foldable. This configuration allows the stool to compactly fold while maximizing the stability of the stool with the addition of a third member. Thus, in one embodiment of the present invention, a foldable, three-legged stool is provided, comprising:

(a) a seat with a first half hingedly interconnected to a second half;

(b) a first member having a top side, a bottom side, and two opposing lateral edges positioned therebetween;

(c) a second member having a top side, a bottom side, and two opposing lateral edges positioned therebetween;

(d) a hinge means interconnecting the first member and the second member along one of the two opposing lateral edges;

(e) a third member having a left half hingedly interconnected to a right half, the left half further hingedly interconnected to the second member along one of the two opposing lateral edges, and the right half hingedly interconnected to the first member along one of the two opposing lateral edges; and wherein, a bottom surface of the first half of the seat is hingedly interconnected to the top side of the first member, and a bottom surface of the second half of the seat is hingedly interconnected to the top side of the second member, wherein the foldable, three-legged stool may be selectively positioned between a first position of use and a second folded position of storage.

It is another aspect of the present invention to provide a four-legged stool with two foldable support members and two non-foldable support members.

It is yet a further aspect of the present invention to provide a foldable stool that has at least one step positioned between a ground surface and upper platform. In one embodiment, the stool has a semi-circular aperture in at least one leg that thereby forms a step. An optional board or platform can also be secured horizontally across the leg of the stool in order to provide more support for the step. Alternatively, a foldable table or stool is provided, wherein the table or stool may preferably comprise one or more built-in shelves or steps. In accordance with at least some embodiments of the present invention, a shelf or step is forwardly-offset relative to a front surface of its support member.

Thus, in one embodiment of the present invention, a foldable device is provided for placement on a substantially horizontal underlying surface, the foldable device comprising:

(a) an upper member providing a substantially horizontal surface when the foldable device is in a use position on the underlying surface, the upper member including a first upper portion hingedly interconnected to a second upper portion;

(b) a first non-folding support member hingedly interconnected to the first upper portion, the first non-folding support member comprising at least one step or shelf, wherein the step or shelf is located at an intermediate elevation along a front surface of the first non-folding support member;

(c) a second non-folding support member hingedly interconnected to the second upper portion; and (d) first and second folding support members hingedly interconnected to the first and second non-folding support members;

wherein the device is collapsible from the use position to a storage position.

In accordance with embodiments of the present invention, the first and second folding support members comprise first and second lateral portions, wherein:

(i) the first lateral portion of the first folding support member is hingedly interconnected to the first non-folding support member;

(ii) the first lateral portion of the second folding support member is hingedly interconnected to the second non-folding support member;

(iii) the second lateral portion of the first folding support member is hingedly interconnected to the second non-folding support member; and (iv) the second lateral portion of the second folding support member is hingedly interconnected to the first non-folding support member.

In accordance with embodiments of the present invention, the first and second lateral portions of the first and second folding members comprise a means for interlocking with the first and second upper portions of the upper member. In accordance with embodiments of the present invention, the means for interlocking comprises at least one projection for reception within a corresponding receptacle located in the bottom surface of the first and second upper portions of the upper member. In accordance with embodiments of the present invention, the second non-folding support member comprises at least one step or shelf. In accordance with embodiments of the present invention, the at least one step or shelf of the second non-folding support member is forwardly-offset relative to a front surface of the second non-folding support member. In accordance with embodiments of the present invention, a distance from a front edge of the step or shelf to the front surface of the first non-folding support member at a top surface of the step or shelf is at least two times greater than a distance from the front surface of the first non-folding support member at the top surface of the step or shelf to a back edge of the step or shelf. In accordance with embodiments of the present invention, the upper member comprises a surface area substantially equal to an area encompassed by the upper edges of the first and second folding and non-folding support members. In accordance with embodiments of the present invention, the foldable device comprises a stool. In accordance with embodiments of the present invention, the upper member comprises a surface area greater than an area encompassed by the upper edges of the first and second folding and non-folding support members, and the foldable device comprises a table.

It is a separate aspect of the present invention to provide a foldable stool having a plurality of steps. Thus, in one embodiment of the present invention, a foldable stool is provided, the foldable stool comprising:

(a) an upper member including a first upper portion hingedly interconnected to a second upper portion;

(b) a first non-folding support member hingedly interconnected to the first upper portion, the first non-folding support member comprising at least two integrally-molded steps, wherein a side-to-side oriented centerline of the steps is forwardly-offset relative to a front surface of the first non-folding support member;

(c) a second non-folding support member hingedly interconnected to the second upper portion; and (d) first and second folding support members comprising hingedly interconnected first and second lateral portions, wherein:

(i) the first lateral portion of the first folding support member is hingedly interconnected to the first non-folding support member;

(ii) the first lateral portion of the second folding support member is hingedly interconnected to the second non-folding support member;

(iii) the second lateral portion of the first folding support member is hingedly interconnected to the second non-folding support member; and (iv) the second lateral portion of the second folding support member is hingedly interconnected to the first non-folding support member;

wherein the stool is collapsible from a use position to a storage position. In accordance with embodiments of the present invention, the first and second lateral portions of the first and second folding members comprise at least one projection for reception within a corresponding at least one receptacle located in a bottom surface of the first and second upper portions of the upper member. In accordance with embodiments of the present invention, the second non-folding support member comprises at least one step. In accordance with embodiments of the present invention, the at least one step of the second non-folding support member includes a side-to-side oriented centerline that is forwardly-offset relative to a front surface of the second non-folding support member. In accordance with embodiments of the present invention, a distance from a front edge of the steps to the front surface of the first non-folding support member at a top surface of the respective step is at least three times greater than a distance from the front surface of the first non-folding support member at the top surface of the respective step to a back edge of the respective step. In accordance with embodiments of the present invention, a total thickness of the stool in a collapsed position is no greater than about 4.5 inches. In accordance with embodiments of the present invention, a handle is formed when the stool is in a collapsed position, the handle comprising opposing apertures in the collapsed position, wherein a first aperture is in said first upper portion and second aperture is in said second upper portion. In accordance with embodiments of the present invention, said first and second lateral portions of said first and second folding members comprise at least one projection for reception within a corresponding receptacle located in the bottom surface of the first and second upper portions of said upper member.

It is a further aspect of the invention to provide a method of using the step stool of the present invention. Thus, a method of using a collapsible step stool is provided, comprising:

a) providing a plurality of molded panels that form the foldable step stool, wherein at least two of the plurality of molded panels are interconnected proximate to an upper surface by a hinge;

b) unfolding the plurality of molded panels from a collapsed position to a use position, wherein the unfolding comprises applying an outward force to at least one of a front panel and a back panel of the plurality of molded panels;

c) locking the plurality of molded panels in the use position;

d) stepping up on to an intermediate step located below a top of the step stool;

e) stepping down off of the intermediate step;

f) unlocking the plurality of molded panels by pulling the top of the step in a generally upward direction; and g) folding the plurality of molded panels from the use position back to the collapsed position, wherein the folding comprises applying an inward force to at least one of the front and back panels.

The method may further comprise carrying the step stool in the collapsed position by grasping a handle formed in the top of the step stool. In addition, the foregoing step of grasping may further comprise inserting a portion of one's hand into at least one aperture located in the in the top of the step stool. The step of locking may comprise causing a contact of at least one projection for reception within a corresponding receptacle located in a bottom surface of the top of the step stool. For method of use, the intermediate step may be forwardly offset from a front surface of a front panel of the plurality of molded panels. In addition, the intermediate step is preferably integrally molded as part of the front panel. For the method of use, the method may further comprise stepping up to a second intermediate step after stepping up to the intermediate step and before stepping down from the intermediate step. In accordance with embodiments of the present invention, the method may also comprise storing the step stool after the folding step, wherein the step stool preferably has a total thickness for storing in the collapsed position of no greater than about 4.5 inches.

It is a further aspect of the present invention to provide a seat that is interconnected to the stool to prevent against loss and is also foldable to minimize storage space. In one embodiment, the stool has a seat that is divided into one or more portions, such as halves, wherein the seat portions are interconnected by a hinge mechanism. The two seat portions are also preferably interconnected to the support members by a similar hinge mechanism. This configuration allows the seat to fold along with the support members that include the legs that contact the underlying surface. In other embodiments, the stool may comprise a rigid seat that is interconnected to just one of the rigid members. This configuration also allows the stool to fold and provides an interconnected seat.

It is also a further aspect of the present invention to provide a foldable stool that uses a non-pinchable hinge mechanism. Thus, various embodiments of the present invention comprise a stool having piano-type hinges that do not pose a safety risk for small children, the elderly, or others more susceptible to injury. Although piano-type hinges are preferred, as appreciated by one skilled in the art, other hinge mechanisms may be used, including barrel and pin hinges, ball and socket hinges, and living hinges.

It is still yet a further aspect of the present invention to provide a foldable stool that has two legs and one or more restraining or tension members, and can carry a higher load capacity than conventional two-legged stools. In one embodiment, the stool has two legs that are hingedly interconnected to a seat and crisscrossing restraining members that limit the range of motion of the two legs and increase the overall load capacity of the stool. Thus, in accordance with one embodiment of the invention, a foldable stool is provided, the stool comprising:

(a) a seat;
(b) a first member having an upper end, a bottom end, and opposing lateral edges positioned therebetween, the upper end hingedly interconnected to the seat;
(c) a second member having an upper end, a bottom end, and opposing lateral edges positioned therebetween, the upper end hingedly interconnected to the seat;
(d) a first restraining member interconnected to a bottom surface of the seat and an interior surface of the first member for restraining an outward distance of travel of the first member with respect to the second member; and
(e) a second restraining member interconnected to a bottom surface of the seat and an interior surface of the second member;

wherein, the foldable stool may be selectively positioned in a first position of use in which the first member is extended outwardly from the second member, and a second position of storage in which the first member and the second member are folded inwardly in a substantially flat position. In accordance with embodiments of the present invention, the seat further comprises an aperture adapted for use as a handle. In accordance with embodiments of the present invention, the first and second members are each hingedly interconnected to the seat by a piano-type hinge. In accordance with embodiments of the present invention, the first and second restraining members are at least one of a chain, a rope, a cable, and a strap.

It is also a further aspect of the present invention to provide a foldable stool that can be positioned relatively close to a vertical surface when in its use position. Thus, in accordance with one embodiment of the invention, a foldable stool is provided, the foldable stool collapsible from a use position to a storage position, the foldable stool comprising:

(a) an upper member including a first upper portion hingedly interconnected to a second upper portion;
(b) a first non-folding support member hingedly interconnected to the first upper portion,
(c) a second non-folding support member hingedly interconnected to the second upper portion; and
(d) first and second folding support members comprising hingedly interconnected first and second lateral portions, wherein:
  (i) the first lateral portion of the first folding support member is hingedly interconnected to the first non-folding support member;
  (ii) the first lateral portion of the second folding support member is hingedly interconnected to the second non-folding support member;
  (iii) the second lateral portion of the first folding support member is hingedly interconnected to the second non-folding support member;
  (iv) the second lateral portion of the second folding support member is hingedly interconnected to the first non-folding support member; and
  (v) when in the use position, the foldable stool is asymmetrical about a plane centered and normal to the first and second folding support members and normal to an underlying surface.

In accordance with embodiments of the present invention, when the foldable stool is in the use position a first interior angle formed between the first upper portion and the first non-folding support member is greater than a second interior angle formed between the second upper portion and the second non-folding support member. In accordance with embodiments of the present invention, a distance from a front edge of the upper member to a point where the first upper portion is hingedly interconnected to the second upper portion is greater than a distance from back edge of the upper member to the point where the first upper portion is hingedly interconnected to the second upper portion.

Various embodiments of the present invention are set forth in the attached figures and in the detailed description of the invention as provided herein and as embodied by the claims. It should be understood, however, that this Summary of the Invention may not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

DETAILED DESCRIPTION

Figure 1:
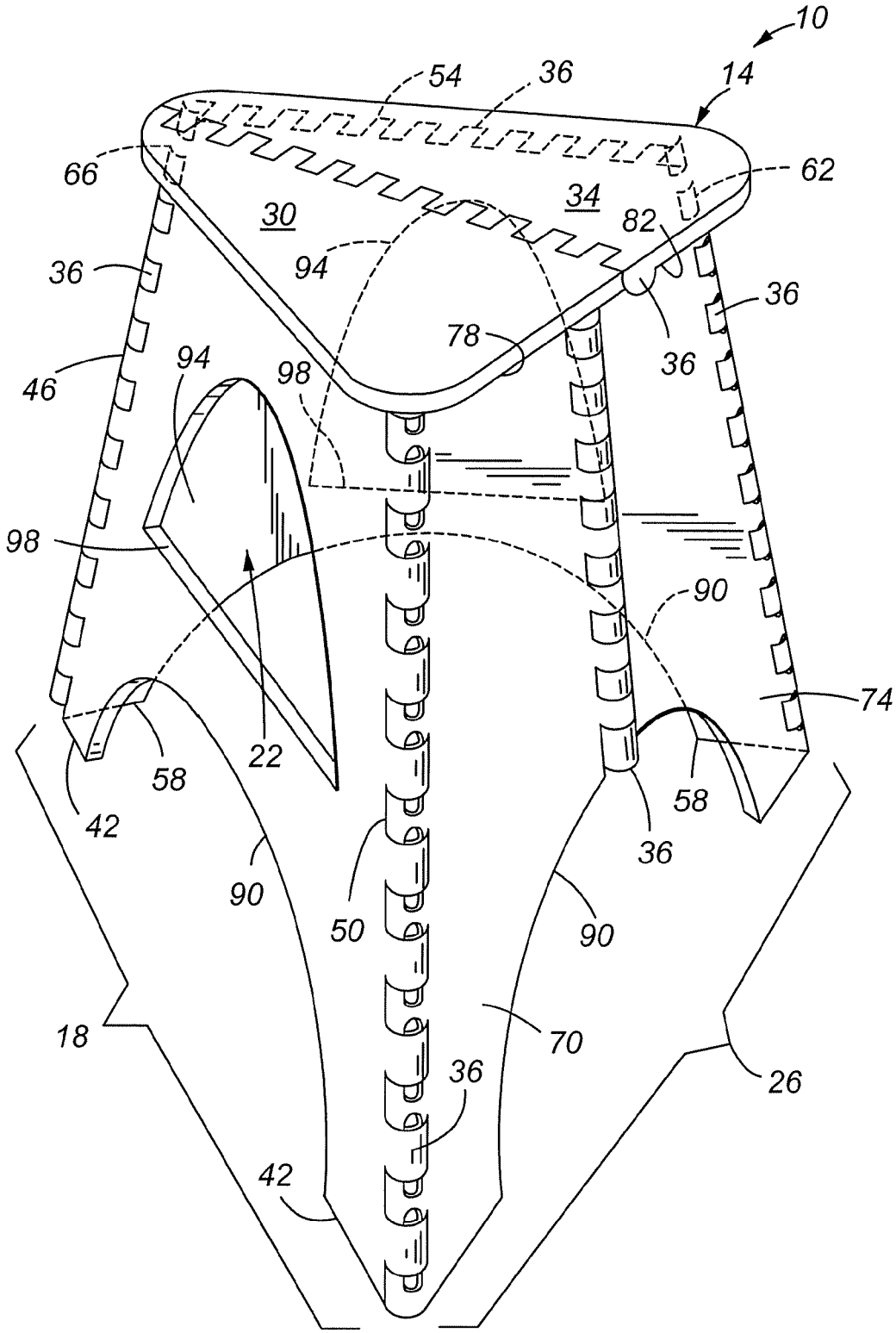
FIG. 1 is a front perspective view of one embodiment of the foldable stool in a first position of use.

As described in detail below, various embodiments of the present invention include novel configurations of stools or tables, some comprising one or more steps and/or other features. Referring now to the drawings, FIG. 1 depicts a front perspective view of a first embodiment of a foldable stool 10 of the present invention. As depicted in FIG. 1, the foldable stool 10 is generally comprised of a seat or upper member 14 supported by first, second, and third support members 18, 22 and 26, respectively. The seat 14 has a first portion 30 hingedly interconnected to a second portion 34 by hinge 36.

Figure 2:
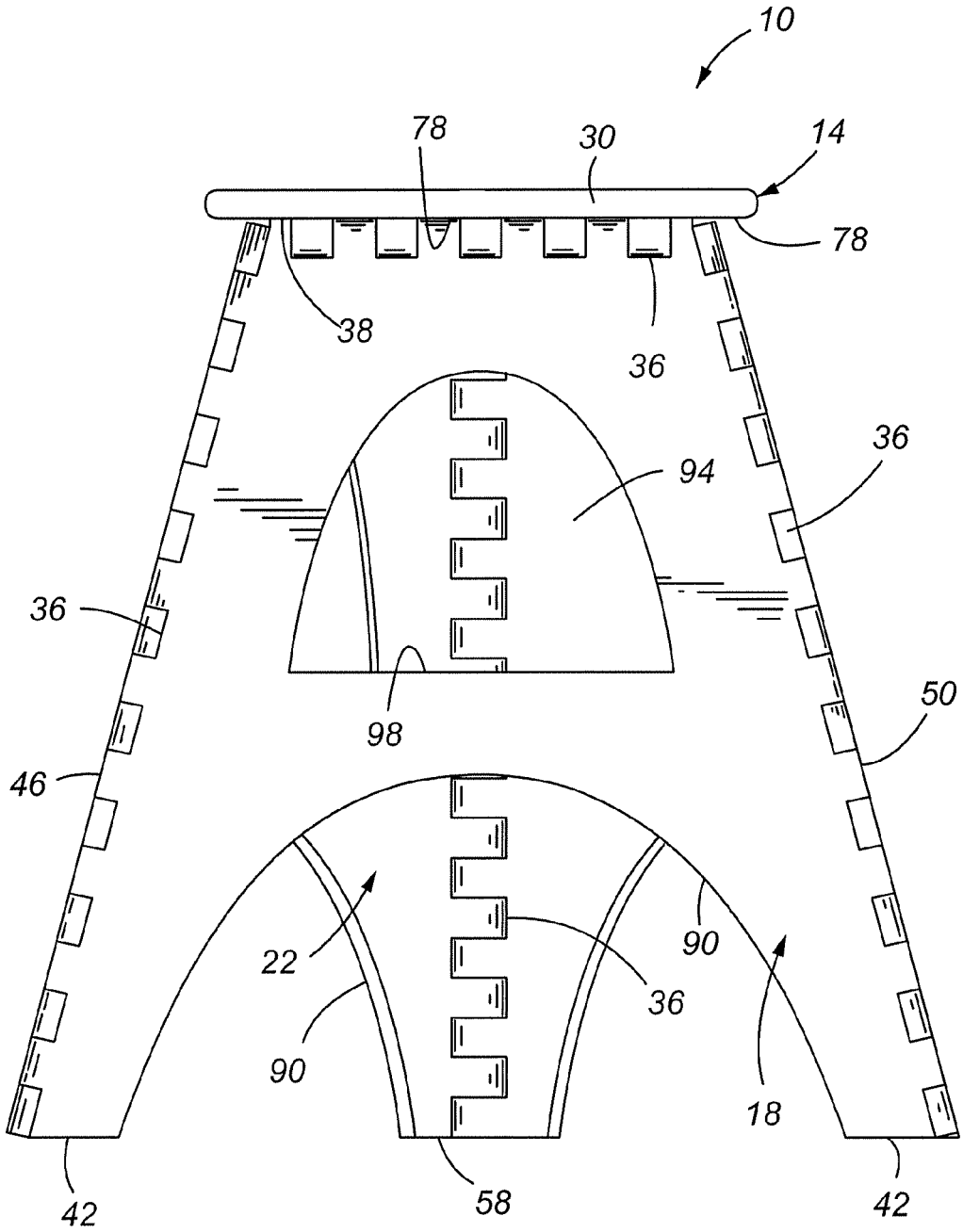
FIG. 2 is a side elevation view of the foldable stool in FIG. 1.

Referring now to FIGS. 1 and 2, the first support member 18 has a top side 38, a bottom side 42, and first and second lateral edges 46 and 50, respectively. Similarly, the second support member 22 (not fully shown in FIG. 2, but is generally identical in shape to the first support member 18) has a top side 54, a bottom side 58, and first and second lateral edges 62 and 66, respectively.

Referring again to FIG. 1, the first lateral edge 46 of the first support member 18 is hingedly interconnected to the second lateral edge 66 of the second support member 22 by hinge 36. In accordance with at least one embodiment of the present invention, the third support member 26 includes a first lateral portion 70 hingedly interconnected by hinge 36 to a second lateral portion 74. The first lateral portion 70 of the third support member 26 is hingedly interconnected by hinge 36 to the second lateral edge 50 of the first support member 18. In addition, the second lateral portion 74 of the third support member 26 is hingedly interconnected by hinge 36 to the first lateral edge 62 of the second support member 22. Thus, the first, second, and third support members 18, 22 and 26, as well as the first and second portions 30 and 34 of the seat 14 are hingedly interconnected by hinges 36. In accordance with embodiments of the present invention, the hinges 36 are preferably a piano-type hinge.

Figure 3:
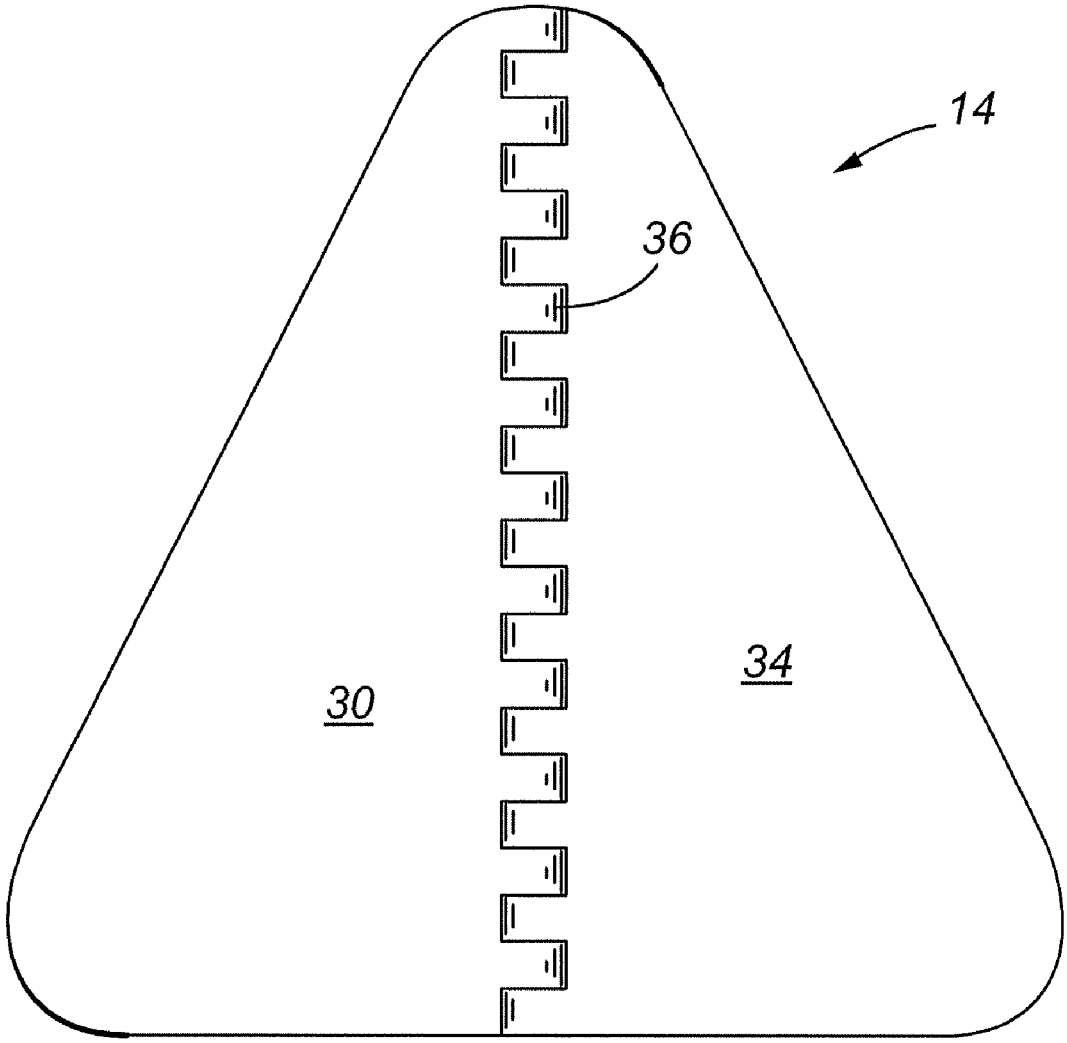
FIG. 3 is a top view of the foldable stool shown in FIG. 1.

The seat 14 can be interconnected to the first and second support members 18 and 22 in at least two different manners. In one embodiment, as shown in FIGS. 1 and 2, a bottom surface 78 of the first portion 30 of the seat 14 is hingedly interconnected to the top side 38 of the first support member 18. Similarly, a bottom surface 82 of the second portion 34 of the seat 14 is hingedly interconnected to the top side 54 of the second support member 22 in a similar manner. In this configuration, neither the first or second portions 30 and 34 of the seat 14 are interconnected to the third support member 26, which facilitates closing the stool 10 into its second position for storage as described below. Also, the first and second portions 30 and 34 of the seat 14 preferably extend past the first and second support members 18 and 22, thereby allowing for seat 14 to comprise a variety of possible shapes. As shown in FIG. 3, the seat 14 is preferably triangular in shape; however, seat 14 could also be made in any shape, such as circular, oval, square, or any other polygonal or asymmetrical shape.

Figure 4:
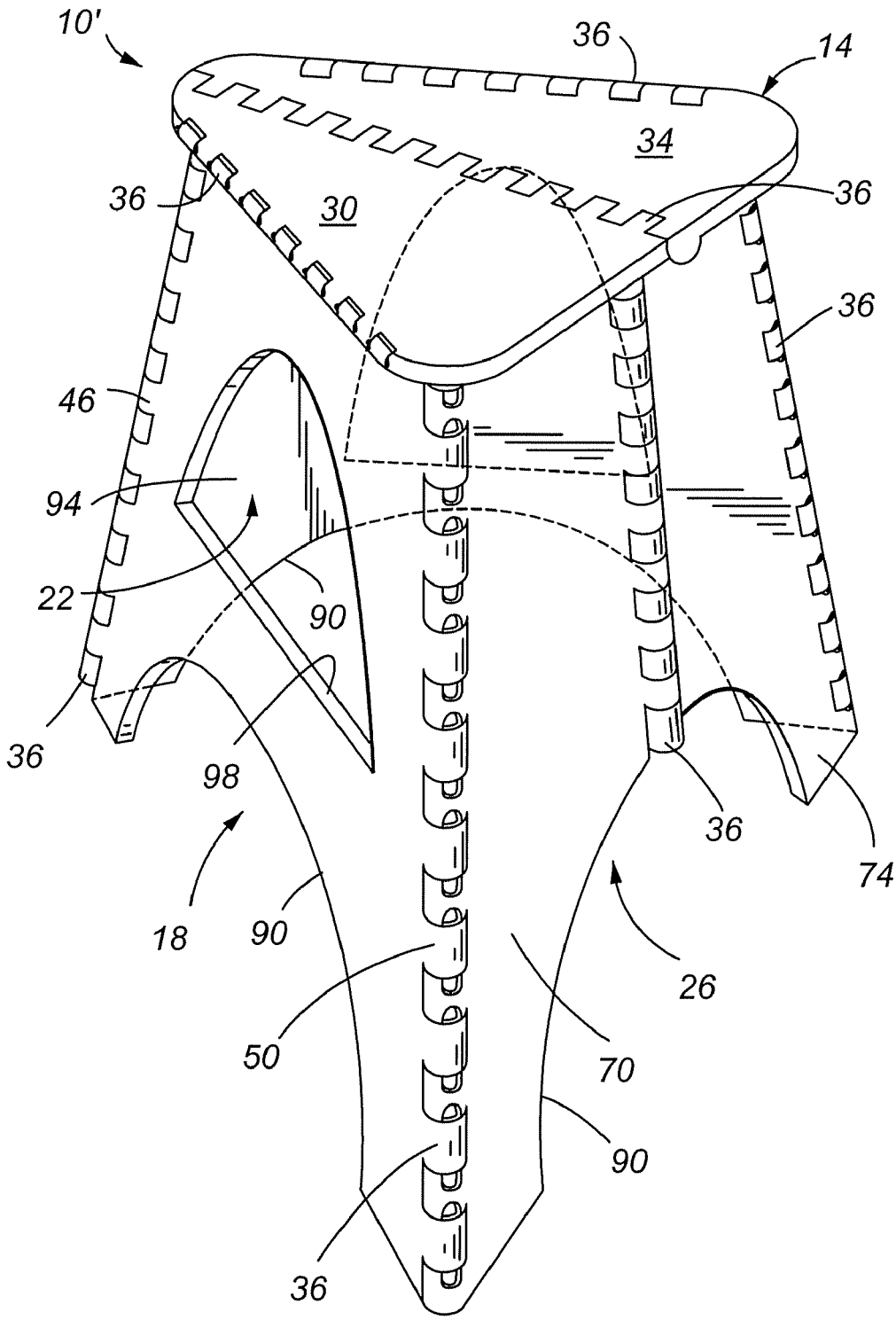
FIG. 4 is a front perspective view of another embodiment of the foldable stool in a first position of use.
Figure 5:
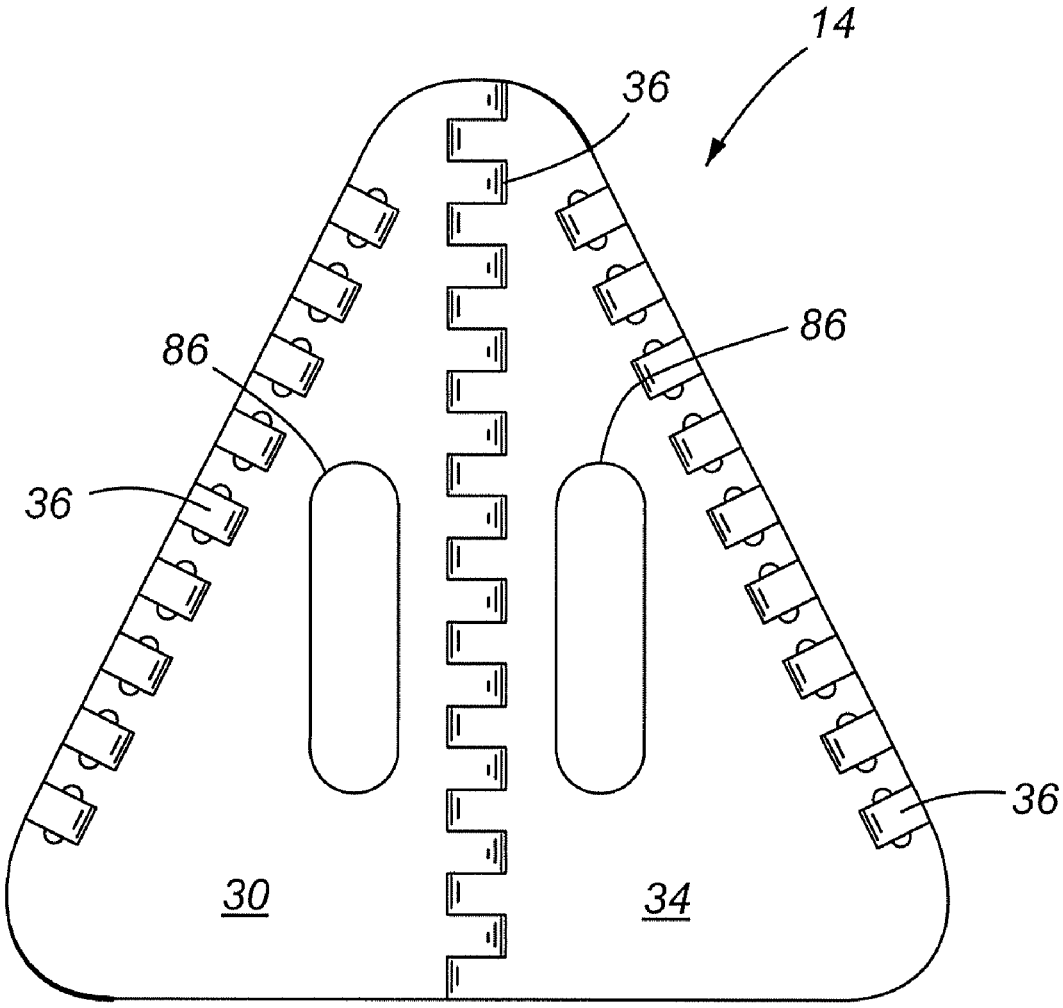
FIG. 5 is a top view of the foldable stool shown in FIG. 4.

Referring now to FIGS. 4 and 5, in an alternative embodiment, stool 10' is provided wherein the first portion 30 of the seat 14 is hingedly interconnected by hinge 36 to the top side 38 of the first support member 18, and the top side 54 of the second support member 22 is hingedly interconnected by hinge 36 to the second portion 34 of the seat 14. In this configuration, the seat 14 is substantially triangular in shape for the seat 14 to properly fold.

In yet another alternative embodiment of the present invention, the seat may also be comprised of a one piece member instead of having the first and second portions as described above. In this configuration, the seat is interconnected to either the first support member 18 or the second support member 22 in either of the manners described above. The main difference between this configuration and the embodiment with first and second portions is how the seat folds; the seat of the one piece model merely folds upward when the stool is folded. Regardless of the configuration, all of the previously described embodiments contemplate that the seat remains interconnected to the stool when the stool is folded for storage.

Figure 6:
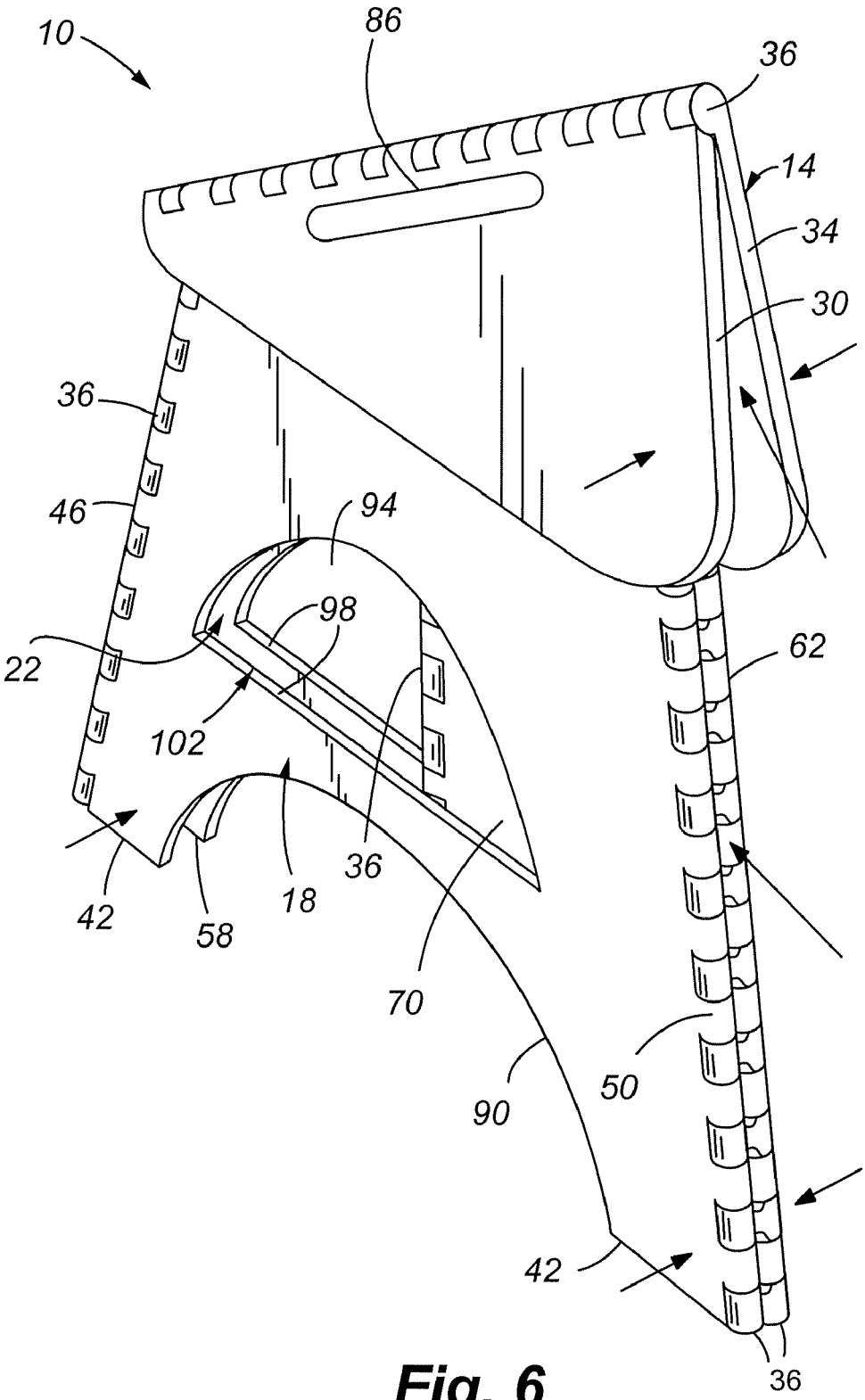
FIG. 6 is a perspective view of the foldable stool of FIG. 1 shown in a second position of storage.
Figure 7:
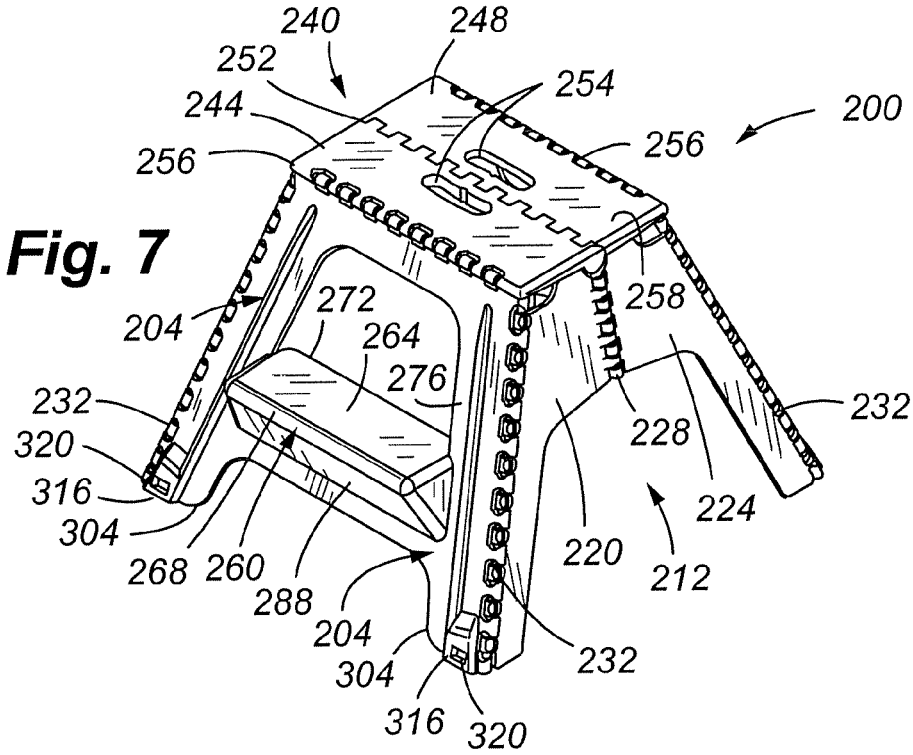
FIG. 7 is a front perspective view of another foldable stool in accordance with embodiments of the present invention.

Regardless of the interconnection of the seat 14 to the first and second support members 18 and 22, the seat 14 may include one or more apertures 86 in each of the first and second portions 30 and 34 of seat 14, wherein the apertures 86 provide a handle for moving the stool 10, 10' when the stool 10, 10' is folded, as shown in FIG. 6.

The first, second, and third support members 18, 22 and 26 can be made in various shapes and sizes. The only constraint on the outlining shapes of the first and second support members 18 and 22 is that the shapes generally mirror each other, which thereby ensures that the first and second support members 18 and 22 will properly fold. While the third support member 26 need not be identical in shape to the first and second support members 18 and 22, it must be the same height as the first and second support members 18 and 22 in order to provide a level seat 14 for the user.

In accordance with embodiments of the present invention, the first and second support members 18 and 22 are each made in a substantially trapezoidal shape that may optionally further comprise an open area, such as an arch structure 90 along its bottom side 42 and 58. The arch structure 90 provides for a support member with a weight-reducing configuration. In another embodiment, the trapezoidal first support member 18 is further comprised of an aperture 94 as shown in FIGS. 1, 2, and 4. The purpose of the aperture 94 is to reduce the weight of the stool 10, 10'. The aperture 94 may be a variety of shapes. In accordance with some embodiments of the present invention, the aperture 94 may comprise at least one straight edge. For example the aperture 94 may be in the form of a rectangle or a square. In one preferred embodiment, the aperture 94 comprises a semi-circular shape. Moreover, the second support member 22 could also have a similar or different shaped aperture 94 in addition to or in replacement of the aperture 94 of the first support member 18. For those stools 10, 10' comprising a substantially horizontal lower edge 98 to the aperture 94, the aperture 94 may be used to provide a step 102 for the user. For added stability, a widened portion, plank, board, or rail can be integrated into or otherwise interconnected to the first support member 18 or second support member 22 along the horizontal lower edge 98. In other embodiments, and as described in detail below, multiple steps can be incorporated into the stool 10, 10'. For example, a plurality of steps can be provided by either increasing the size of the aperture 94 in the first support member 18 and interconnecting additional planks or rails in parallel across the aperture 94, or by adding additional apertures in the first support member 18 above the aperture 94. By adding more steps 102, the height of the stool 10, 10' can also be varied. As the height of the stool 10, 10' is increased, the stool 10, 10' can be adapted for use as a sawhorse, table, or ladder.

As shown in FIGS. 1, 2, and 4, the preferable perimeter shape of the first, second, and third support members 18, 22 and 26 is substantially trapezoidal, i.e., having a greater width in proximity to the floor in order to provide additional support. As used herein, the term "trapezoidal" means a quadrilateral having at least two parallel sides, although various shaped apertures may be positioned within the trapezoidal perimeter shape for functional or decorative purposes.

In addition, the first, second, and third support members 18, 22 and 26 do not have to be solid members. The first, second, and third support members 18, 22 and 26 simply need to be formed in a shape with at least two parallel edges—one edge to support the seat 14 and the other to maintain level contact with an underlying surface. For example, the first and/or second support members 18 and 22 may comprise the shape of a flattened arch, a trapezoid, or a triangle. Similarly, the third support member 26 could be comprised of a tubing that forms a perimeter shape of a trapezoid as well as other shapes. If tubing is used, steps 102 can be created by stringing horizontal rails or tubes across the first and/or second support members 18 and 22 in a manner that replicates the rungs of a ladder. Thus, in accordance with some embodiments of the present invention, the resultant stool is comprised of two rigid first and second support members 18 and 22 that are moveably interconnected to each other as well as to a foldable third support member 26.

In a preferred embodiment of the present invention, the first, second, and third support members 18, 22 and 26 generally form the shape of an equilateral triangle. As long as the first and second support members 18 and 22 are similar in shape and width, the third support member 26 can be made in a similar shape, but with a larger or smaller width than the first and second support members 18 and 22, thereby generally creating the shape of an isosceles triangle. Again, all three support members are substantially the same height in order to provide a safe and level seat 14.

While it is preferable to use piano-type hinges for these hinged interconnections, other means that moveably or rotatably interconnect these various components are also considered within the scope of the invention. Preferably, means for interconnecting the various components comprises a non-pinching mechanism. Such other mechanisms may, for example, comprise a single hinge mechanism positioned on a lower surface of the first and second halves of the seat, and such mechanism could be utilized and positioned in such a manner to reduce any possible pinch points. Various springs or other types of biasing devices could be used in conjunction with any of the previously described hinged interconnections to assist with the opening or closing of the stool. For example, springs, metallic band springs or other similar devices commonly known in the art could be used for the same purpose. If the first, second, and third support members 18, 22 and 26 are made out of tubular materials, various hinges, rings, bands (e.g., rubber), or other non-pinching means for moveably or rotatably interconnecting these components may be used as appreciated by one skilled in the art. Of course, biasing means such as those described above, may also be used in conjunction with these moveable or rotatable interconnections. Also, multiple latches can be used to lock the seat 14 and the first, second, and third support members 18, 22 and 26 in a first position of use. Although discussed with regard to stool 10 and 10', it is to be understood that the foregoing discussion regarding the means for interconnecting the components applies to all foldable devices described herein.

In order to minimize weight without sacrificing strength and stability, the stool 10, 10' is preferably made out of plastic, fiberglass, aluminum, or other rigid, non-brittle material, which is durable and not likely to wear or break during continual use. However, as appreciated by one skilled in the art, other materials such as wood, metal or other materials, or a mixture thereof may additionally be used. Again, although discussed with regard to stool 10 and 10', it is to be understood that the foregoing discussion regarding the materials used to form the foldable stool 10 and 10' applies to all devices described herein.

The foldable stool 10, 10' of the present invention generally has two positions, including a first position of use and a second position of storage. As shown in FIG. 1, the first support member 18, second support member 22, third support member 26, and seat 14 are extended in the first position of use. FIG. 6, on the other hand, depicts the foldable stool 10 in the second position of storage. In order to fold the stool 10 (or 10') into the second position of storage, the user simultaneously lifts the first and second portions 30 and 34 of the seat 14 upward while pushing on the first and second portions 70 and 74 of the third support member 26 inward and pulling the first support member 18 and second support member 22 toward each other. Alternatively, one could push the first and second portions 70 and 74 of the third support member 26 outward, which additionally allows the stool 10 to fold. As shown in FIG. 6, this motion is completed when the first and second portions 70 and 74 of the third support member 26 abut each other as well as the interconnected first and second support members 18 and 22. As a result, the first and second portions 30 and 34 of the seat 14 become folded downward and rest on the first and second support members 18 and 22. If the seat 14 extends past the first and second support members 18 and 22, the first and second portions 30 and 34 of the seat 14 will not rest on the first and second support members 18 and 22. If the seat 14 is comprised of a one piece construction and, hence, attached to only the first support member 18 or the second support member 22, the seat 14 will not fold downward, but rather will fold upward and be substantially parallel with the first and second support members 18 and 22. All of these embodiments allow the stool 10 to be stored in a confined space as opposed to typical prior art devices.

Referring now to FIGS. 7-15, various views are shown of another embodiment of the present invention comprising folding stool 200. Folding stool 200 generally comprises a rectangular footprint for contacting an underlying surface, wherein the folding stool 200 contacts the underlying surface at its four corners. The folding stool 200 generally includes a first non-folding support member 204 and a second non-folding support member 208. In addition, first and second folding support members 212 and 216 are located between the first non-folding support member 204 and the second non-folding support member 208. The first and second folding support members 212 and 216 preferably comprise first and second lateral portions 220 and 224. The first and second lateral portions 220 and 224 of the folding support members 212 and 216 are preferably hingedly interconnected by hinges 228. In addition, one lateral edge of each of the first and second lateral portions 220 and 224 is hingedly interconnected to one of the first and second non-folding support members 204 and 208 by a corner hinge 232.

The folding stool 200 also includes an upper member 240 comprising a first upper portion 244 and a second upper portion 248 that are hingedly interconnected by upper hinge 252. The first upper portion 244 is also hingedly interconnected by upper edge hinge 256 to the first non-folding support member 204, and the second upper portion 248 is hingedly interconnected by another upper edge hinge 256 to the second non-folding support member 208. The upper hinge 252 and upper edge hinges 256 are preferably a piano type hinge. In addition, portions of the hinges 252 and 256 form part of the upper surface 258 of the upper member 240, so that if a person stands or sits on the upper member 240, they may contact portions of the hinges 252 and 256. The first and second upper portions 244 and 248 preferably include apertures 254 to provide a handle for carrying the stool 200.

Figure 8:
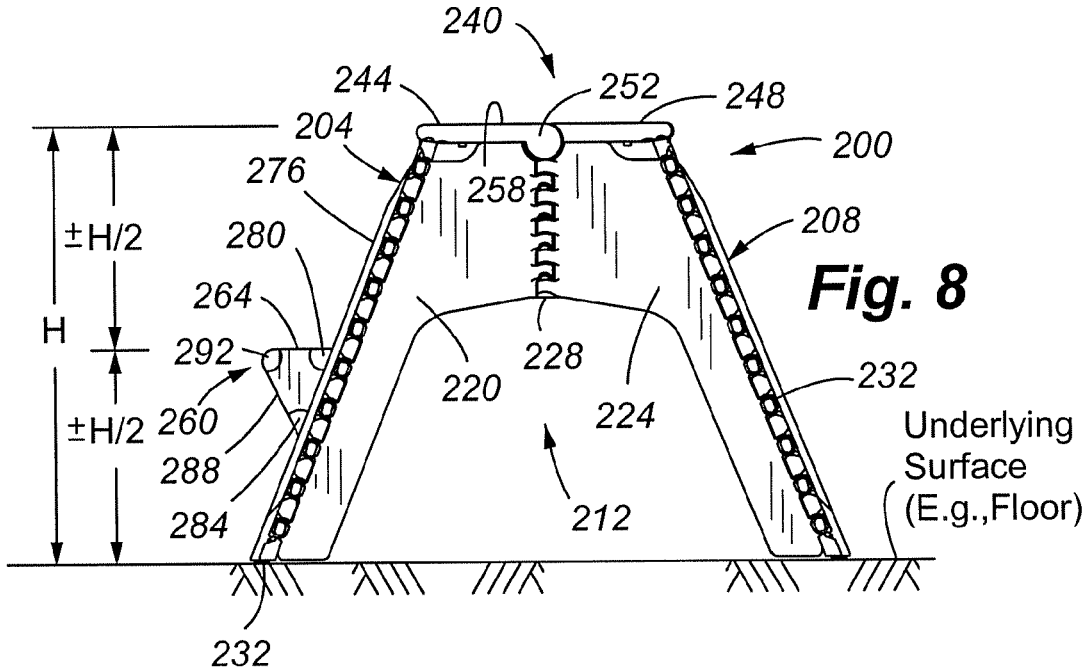
FIGS. 8 and 9 are side elevation views of the foldable stool shown in FIG. 7.
Figure 9:
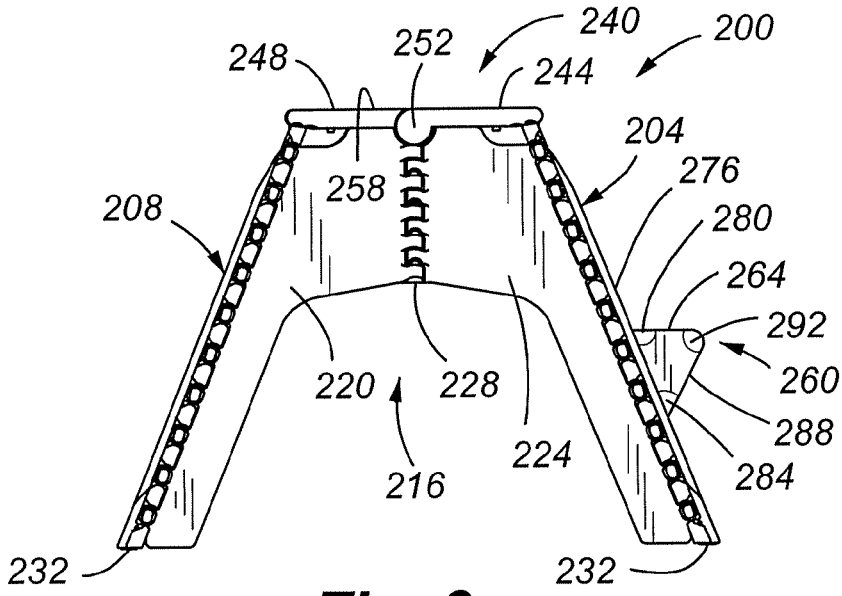
Figure 10:
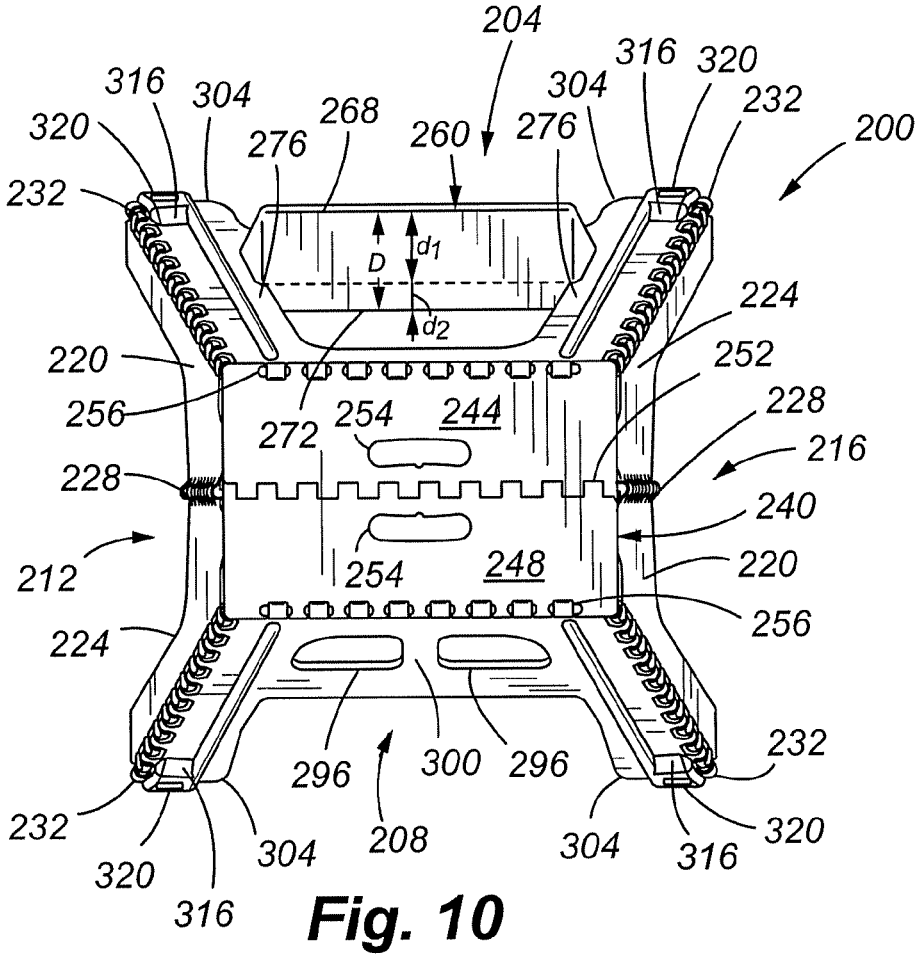
FIG. 10 is a top plan view of the foldable stool shown in FIG. 7.

Referring still to FIGS. 7-15 and in accordance with embodiments of the present invention, the first non-folding support member 204 preferably comprises a step 260, wherein the step 260 includes an upper surface 264 that permits a person to stand on the step 260 when the stool 200 is in its use position; thus, the upper surface 264 of step 260 is substantially horizontal when the stool 200 is placed on a flat underlying surface. The step 260 preferably has a depth adapted for receiving a sufficient portion of a person's foot such that the person can maintain their balance when standing on the step. As best seen in FIG. 10, and in accordance with at least one embodiment of the present invention, the step 260 has a step depth D from a front edge 268 to a back edge 272 of the upper surface 264. A variety of actual values for the step depth D may be used. Accordingly, by way of example and not limitation, a step depth D of between about 1 to 8 inches may be used, and more preferably, a step depth D of between about 3 to 6 inches may be used, and more preferably yet, a step depth D of about 4 inches is contemplated for various embodiments of the present invention. The various possible values for the step depth D are considered within the scope of the present invention.

The step depth D as defined herein comprises a front depth d1 plus a back depth d2. As further defined herein, the front depth d1 is the distance from the front edge 268 of the step 260 to the front surface 276 of the first non-folding support member 204 at the intersection location between the upper surface 264 of the step 260 and the front surface 276 of the first non-folding support member 204. The back depth d2 is the distance from the front surface 276 of the first non-folding support member 204 to the back edge 272 of the step 260. In accordance with at least one embodiment of the present invention, the ratio of d1 to d2 (that is, d1÷d2) is greater than 1.0, such that the step 260 is eccentrically positioned relative to the front surface 276 of the first non-folding support member 204. More preferably, the ratio of d1 to d2 is between about 1.5 to 4.0, and more preferably yet, between about 2.0 and 3.5, and still more preferably yet, about 3.0. Accordingly, a greater portion of the depth of the step is projected forward of the front surface 276 of the first non-folding support member 204. Thus, as used herein, "eccentrically" means not centered, so that the step comprises a side-to-side oriented centerline dividing the depth of the step in two, wherein the side-to-side centerline is forward or forwardly-offset of the front of the surface 276 of the first non-folding support member 204. This advantageously allows the stool 200 to be folded into a thinner profile than if the ratio of d1 to d2 was around 1.0. In accordance with embodiments of the present invention, the total thickness of the step stool in a collapsed position is less than about 6 inches, and more preferably, less than about 5 inches, and more preferably yet, equal to or less than about 4.5 inches.

Utilization of an eccentrically positioned or forwardly-offset step 260 is accommodated by the configuration of the step 260 relative to the front surface 276 of the first non-folding support member 204. In accordance with embodiments of the present invention, step 260 comprises a substantially triangular shape when viewed from a side elevation view, such as that shown in FIG. 8. A step top angle 280 is defined herein as the angle within the step 260 between the top surface 264 of the step 260 and the front surface 276 of the first non-folding support member 204. In addition, a step bottom angle 284 is defined herein as the angle within the step 260 between a step return surface 288 and the front surface 276 of the first non-folding support member 204. Finally, a step exterior angle 292 is defined herein as the angle between the top surface 264 of the step 260 and the step return surface 288. In accordance with embodiments of the present invention, the step top angle 280 and step exterior angle 292 are preferably between about 60 and 70 degrees, and the step bottom angle 284 is between about 40 and 60 degrees, and more preferably, the step top angle 280 and step exterior angle 292 are preferably between about 63 and 67 degrees, and the step bottom angle 284 is between about 46 and 54 degrees, and more preferably yet, the step top angle 280 is about 67 degrees, the step exterior angle 292 is about 65 degrees, and the step bottom angle 284 is between about 48 degrees. Such angles advantageously allow the stool 200 to include the forwardly-offset step 260, thereby providing a thinner profile when the stool 200 is folded into its collapsed storage position.

As best seen in FIGS. 8 and 9, the upper surface 264 of step 260 is located between about 40 to 60% of the height H of support members 204, 208, 212, or 216, and more preferably, the upper surface 264 of the step 260 is located about 50% of the height H. Thus, the location of the step 260 is conveniently located to substantially subdivide the height of the stool 200, thereby making it relatively easy for the user to ascend to the upper member 240 of the stool 200 to stand on the stool 200.

Figure 11:
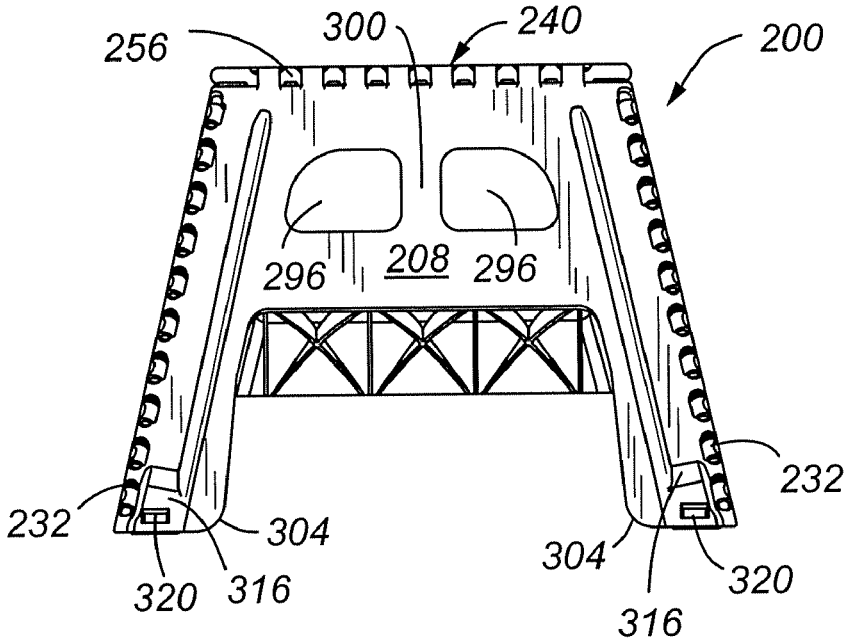
FIG. 11 is a rear elevation view of the foldable stool shown in FIG. 7.
Figure 12:
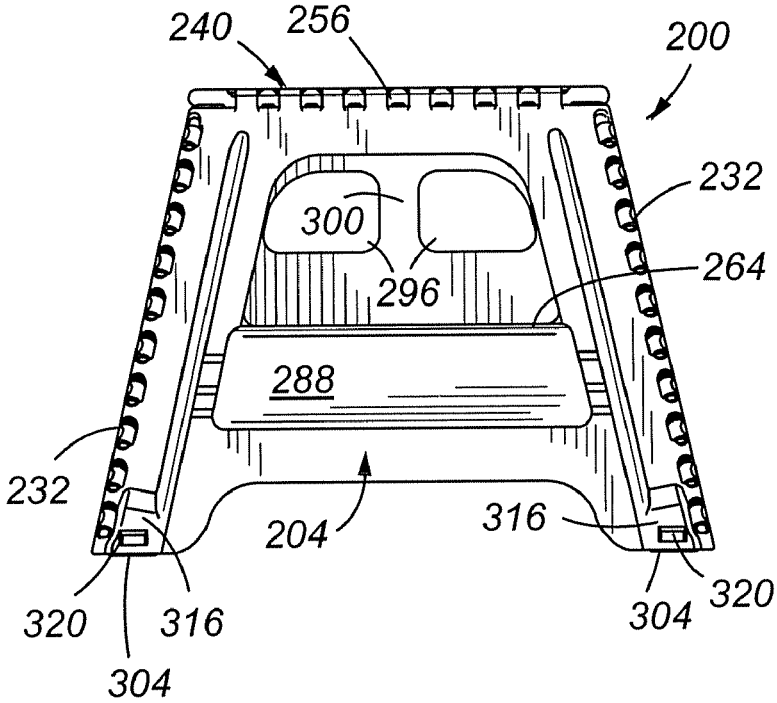
FIG. 12 is a front elevation view of the foldable stool shown in FIG. 7.
Figure 13:
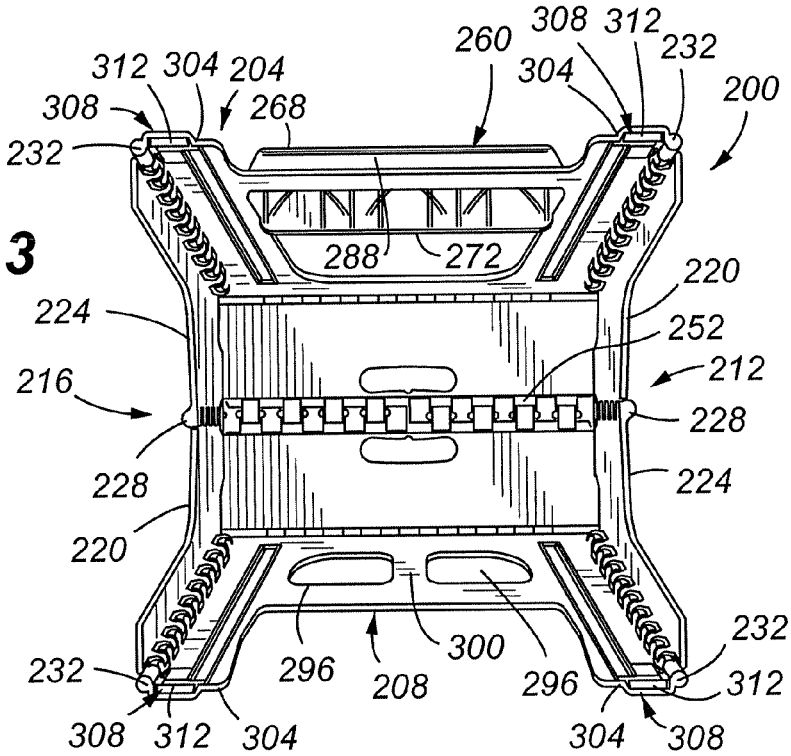
FIG. 13 is a bottom elevation view of the foldable stool shown in FIG. 7.

Referring now to FIGS. 10-12, and in accordance with embodiments of the present invention, the second non-folding support member 208 of stool 200 may comprise one or more openings 296 to reduce the weight of stool 200 and to provide one or more additional locations to allow a user to easily grasp and/or manipulate the stool 200. For example, the vertical section 300 located between the two openings 296 may be used to grasp the second non-folding support member 208 when expanding the stool 200 from its collapsed storage position to its expanded use position.

In accordance with embodiments of the present invention, the stool 200 is preferably formed of a material capable of supporting an adult, whether the adult is standing or sitting on the stool 200. Thus, by way of example and not limitation, the stool 200 may comprise a metal or metal alloy, a plastic other synthetic material, a hard rubber, or combinations of the foregoing.

Referring now to 13, although not required, the legs 304 of the non-folding support members 204 and 208 optionally include a friction enhancing structure. In one embodiment, the friction enhancing structure comprises an insert or plug 308 that includes a bearing surface 312 for contacting an underlying surface that the stool 200 is placed on. By way of example and not limitation, the plug 308 may comprise a material (such as a soft rubber or plastic) having a relatively high coefficient of friction when contacting typical flooring materials. In accordance with at least one embodiment of the present invention, the legs 304 include receptacles 316 for receiving and holding the plugs 308. The receptacles 316 may further comprise a window 320, wherein if a plug 308 has a color contrasting with the color of the leg 304 of the non-folding support members 204 and 208, then the user can more easily identify if a plug 308 is missing from a leg 304, wherein such a feature improves the safety of the stool 200.

Figure 14:
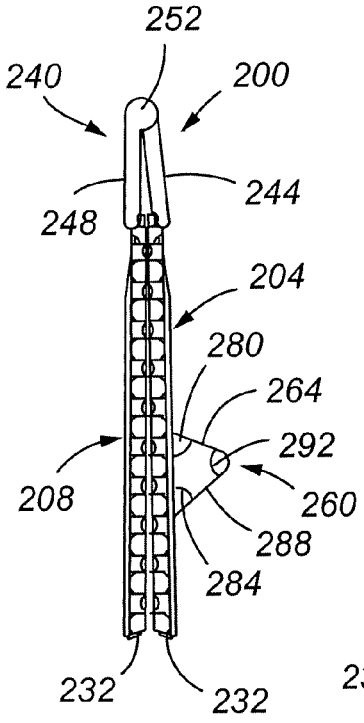
FIG. 14 is a side elevation view of the foldable stool shown in FIG. 7 in its collapsed or folded storage position.
Figure 15:
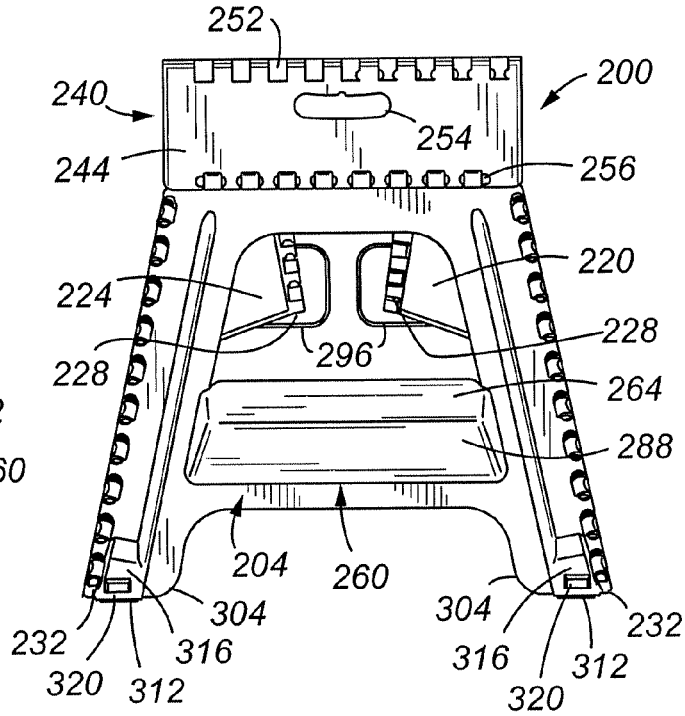
FIG. 15 is a front elevation view of the collapsed foldable stool shown in FIG. 14.

Referring now to FIGS. 14 and 15, the stool 200 is shown in its folded or storage position. As can be seen in FIG. 15, the folding support members 212 and 216 fold inward and the first and second portions 244 and 248 of upper member 240 fold upward, wherein the apertures 254 align to facilitate a handle for easily carrying the stool 200.

Figure 16:
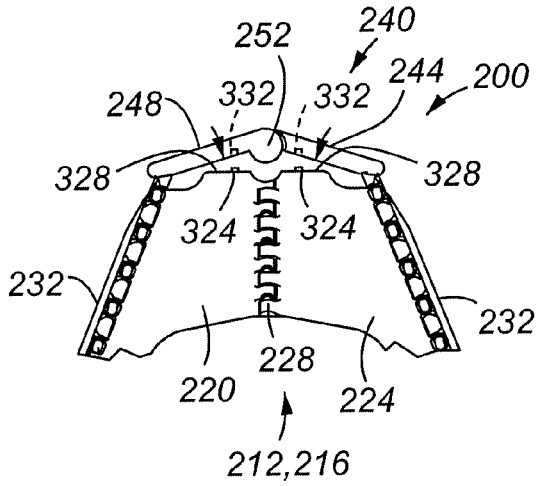
FIG. 16 is a partial side elevation view of the foldable stool shown in FIG. 7 in a partially opened/collapsed position.
Figure 17:
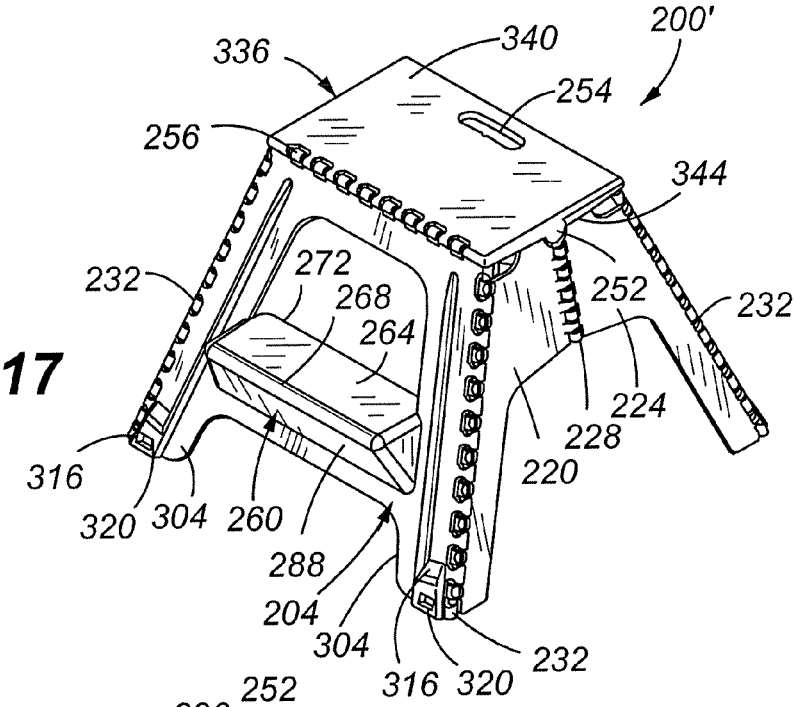
FIG. 17 is a front perspective view of another foldable stool in accordance with embodiments of the present invention.
Figure 18:
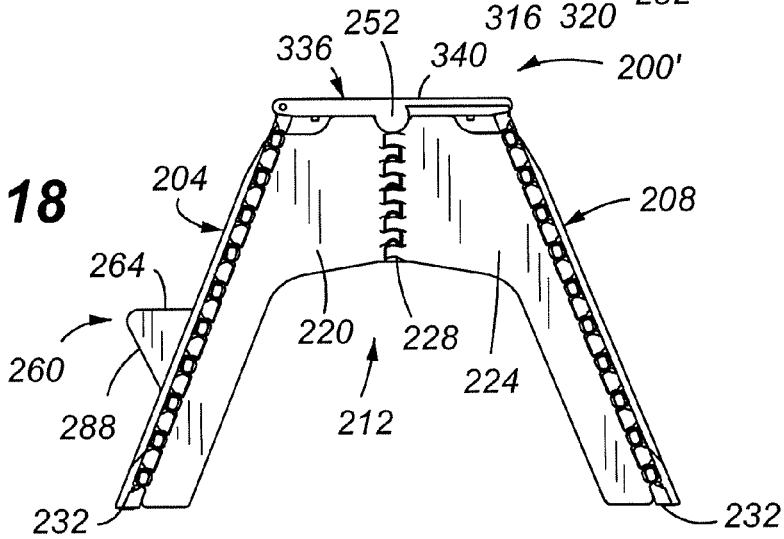
FIG. 18 is a side elevation view of the foldable stool shown in FIG. 17.
Figure 19:
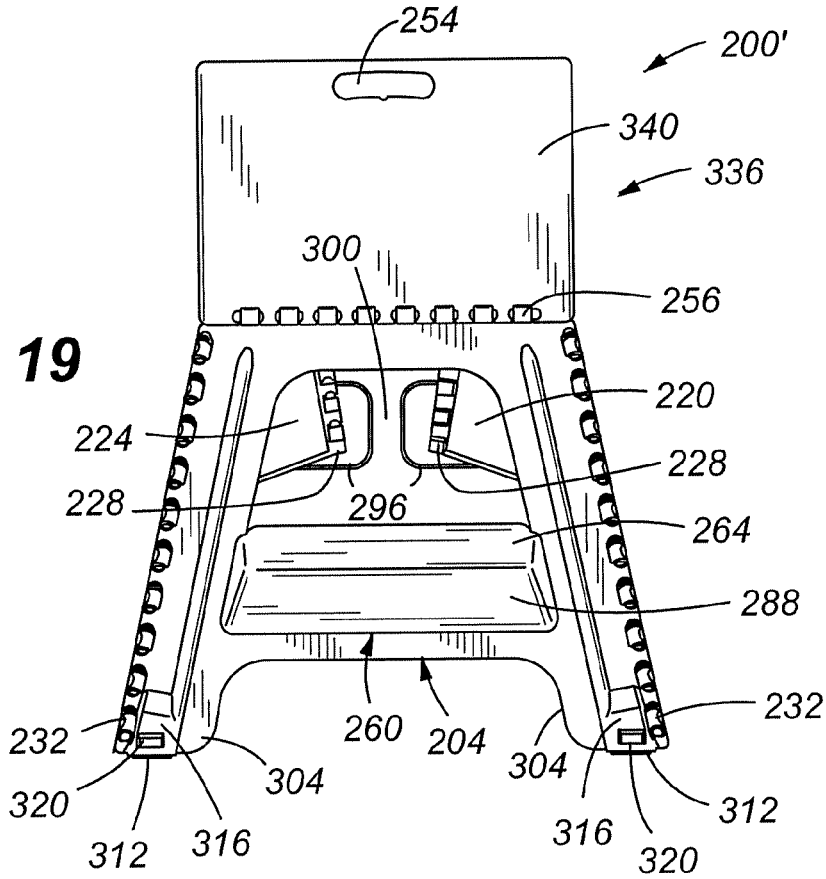
FIG. 19 is a front elevation view of the foldable stool shown in FIG. 17 in its collapsed or folded storage position.
Figure 20:
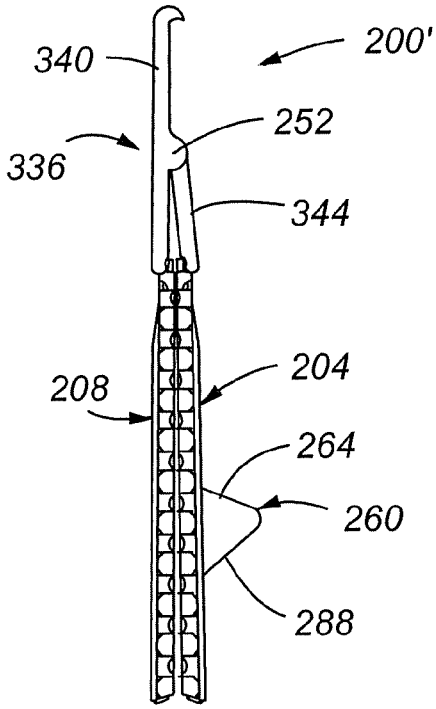
FIG. 20 is a side elevation view of the collapsed foldable stool shown in FIG. 19.

Referring now to FIG. 16, and in accordance with embodiments of the present invention, the stool 200 may comprise a means for locking the stool 200 in its expanded or use position. By way of example and not limitation, such means for locking may comprise a projection 324 on one or more of the folding support members 212 and 216, wherein the projection 324 is received within a corresponding receptacle of the upper member 240. As shown in FIG. 16, a projection 324 is located on an upper surface 328 of each of the first and second lateral portions 220 and 224 of the folding support members 212 and 216. Upon expansion of the stool 200 to its use position, the first and second upper portions 244 and 248 of the upper member 240 are rotated toward the upper surface 328 of the lateral portions 220 and 224. The projections 324 are then received within the receptacles 332 within the first and second upper portions 244 and 248 to lock the stool 200 in its use position. Of course, other means for locking and/or other configurations are possible, such as projections located on the underside of the first and second upper portions 244 and 248 with receptacles within the first and second lateral portions 220 and 224 of the folding support members 212 and 216, or alternatively, other locking means may be used, such as a clasp, latch, detent, etc. as will be familiar to those skilled in the art.

Referring now to FIGS. 17-20, another embodiment of the present invention is shown comprising a folding stool 200' having an upper member 336 with a one-piece upper portion 340 that at least partially overlaps a hingedly interconnected underlying portion 344. The continuous one-piece upper portion 340 provides additional strength to the upper member 336. Stool 200' may include a variety of features of the stool 200, including step 260. In addition, although different in configuration, the one-piece upper portion 340 may comprise an aperture 254 to provide a handle for carrying the stool 200'.

Figure 21:
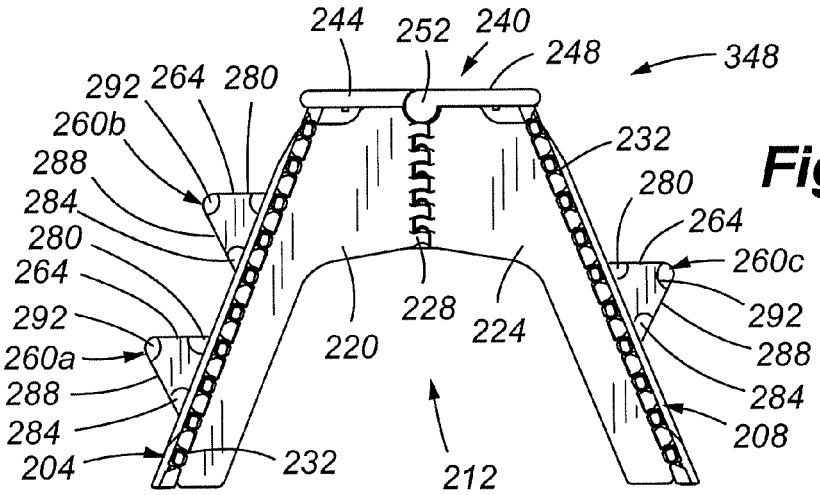
FIG. 21 is a side elevation view of another foldable stool in accordance with embodiments of the present invention.
Figure 22:
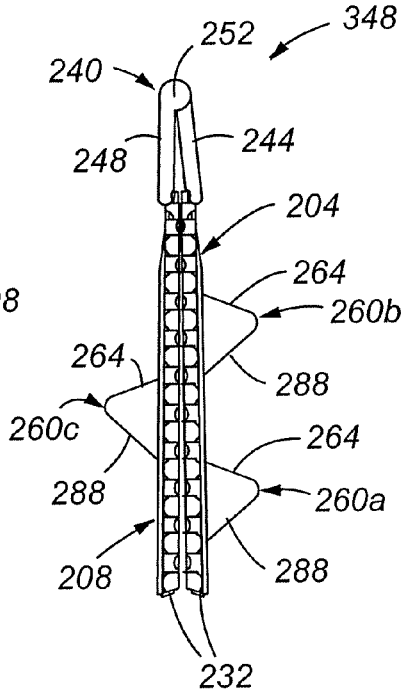
FIG. 22 is a side elevation view of the collapsed foldable stool shown in FIG. 21.

Referring now to FIGS. 21 and 22, yet another embodiment of the present invention is shown as stool 348, wherein the stool 348 includes a plurality of steps 260. More particularly, the first non-folding member 204 includes first and second steps 260*a* and 260*b*, respectively. The first and second steps 260*a* and 260*b* are preferably evenly distributed along the height of the support member 204. In accordance with embodiments of the present invention, the second non-folding support member 208 may also comprise a step 260. Accordingly, as shown in FIGS. 21 and 22, the stool 348 includes steps 260 on both the non-folding support members 204 and 208. More particularly, the second non-folding support member 208 may comprise one or more steps, such as step 260*c*. The use of two steps 260*a* and 260*b* on first non-folding support member 204 with a single step 260*c* on the second non-folding support member 208 lends application for use of the stool 348 by people of different height who may find it easier to use two steps 260*a* and 260*b* to ascend to the upper member 240, while others using the same stool 348 may simply use step 260*c* to ascend to the upper member 240. Also, the use of steps 260 on either side of the stool 348 adds utility to the stool 348 because the stool 348 can be set up in different orientations with one or more steps 260 provided on either side.

When folded in the second position of storage, the various stools of the present invention have a width that varies according to the materials used and the stool geometry and size. Generally, the width of stool 10, 10', 200, 200' and 348 in a folded position measures 3 to 7 inches, and more preferably, the width of stool is no greater than about 4 inches.

Figure 23:
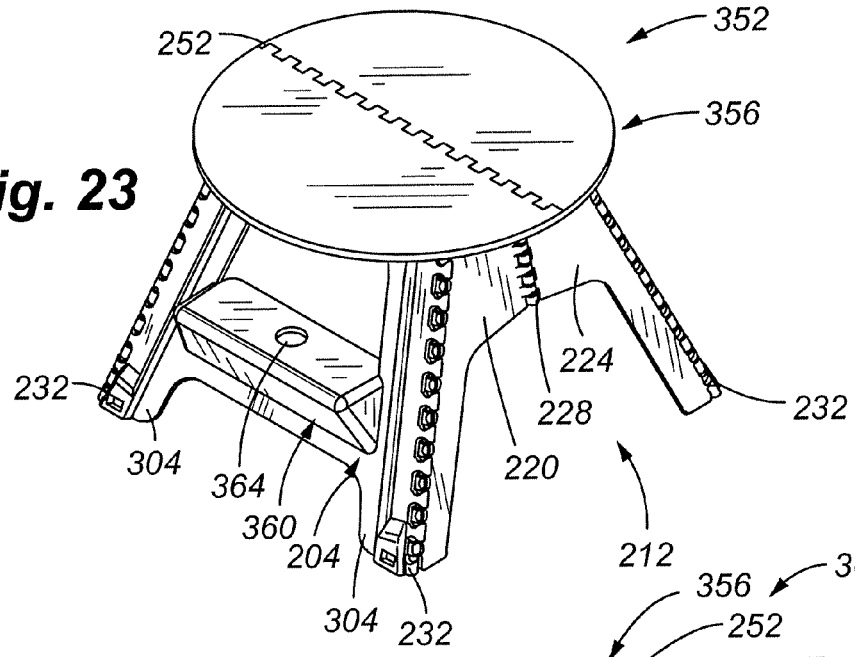
FIG. 23 is a front perspective view of a foldable table in accordance with embodiments of the present invention.
Figure 24:
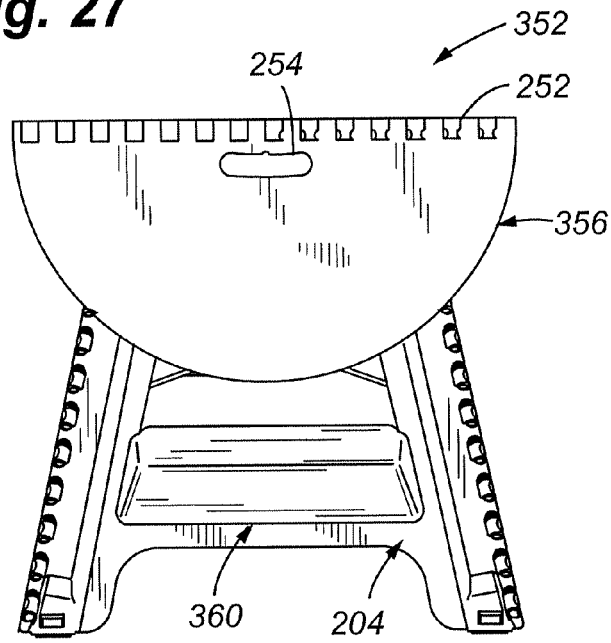
FIG. 24 is a front elevation view of the foldable table shown in FIG. 23 in its collapsed or folded storage position.

Referring now to FIGS. 23 and 24, yet another embodiment of the present invention is shown as foldable table 352, wherein the table 352 comprises non-foldable support members 204 and 208 as discussed above, and wherein an oversized upper member 356 is used. More particularly, the oversized upper member 356 includes additional surface area, wherein the oversized upper member 356 extends laterally beyond the upper edges of the foldable and non-foldable support members 204, 208, 212 and 216 when the foldable table 352 is in its expanded or use position. The oversized upper member 356 may comprise hinges on its underside to hingedly interconnect the oversized upper member 356 to the first and second non-foldable support members 204 and 208. The height H of the foldable table 352 may be sized for providing a comfortable table height for a variety of people, including a smaller height for children and a greater height for adults. In addition, when used in the table 352, one or more convenient shelves 360 may be provided along the sides of the table 352, wherein the shelves 360 may have a depth for facilitating the placement of objects on it. In addition, the shelves 360 may include additional features for holding objects, such as, by way of example and not limitation, one or more cup holders 364 or recesses for cradling objects, such as silverware, crayons, and the like. As shown in FIG. 24, the foldable table 352 preferably includes an aperture 254 for allowing a user to easily carry the foldable table 352 when it is collapsed in its storage position.

Figure 25:
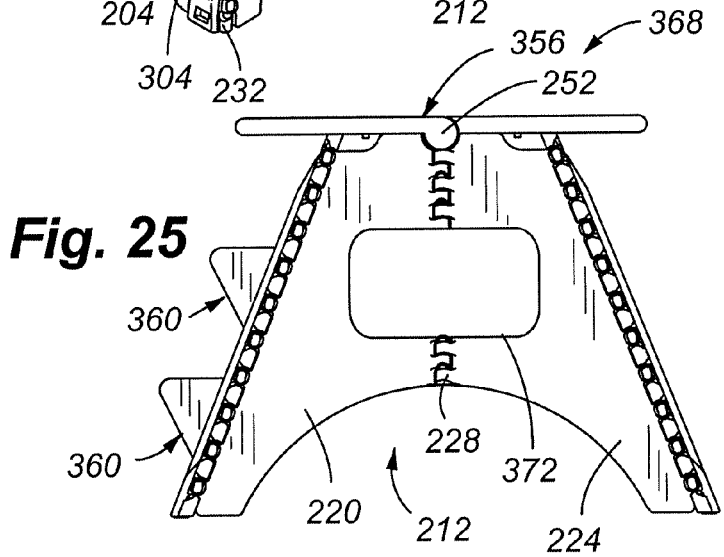
FIGS. 25-27 are side elevation views of foldable tables in accordance with embodiments of the present invention.

Referring now to FIG. 25, another embodiment of the present invention is shown as foldable table 368. The table 368 includes an opening 372 along its foldable support member 212, thereby reducing the weight of the table 368. In addition, foldable table 368 features a plurality of shelves 360.

Figure 26:
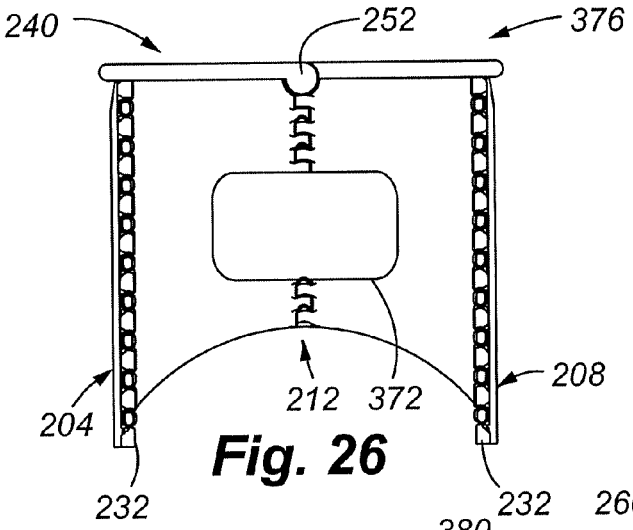

Referring now to FIG. 26, a further embodiment of the present invention comprising a foldable table 376 is shown, wherein the table 376 comprises support members that are substantially vertical when placed in their expanded or use position. FIG. 26 further illustrates that foldable tables in accordance with embodiments of the present invention do not need to include an oversized top, and that the over-sizing of the upper member is optional. In addition, FIG. 26 further illustrates that the use of shelves 360 is also optional.

Figure 27:
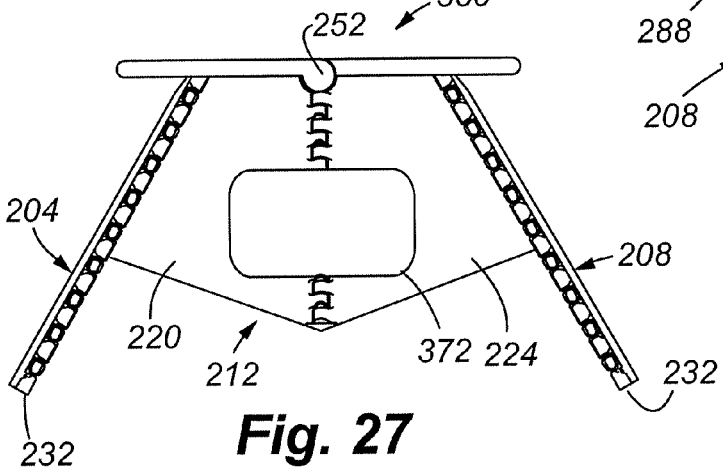

Referring now to FIG. 27, a further embodiment of the present invention comprising a foldable table 380 is shown, wherein the table 380 comprises support members that form a relatively wide footprint at their bottom for contacting the underlying surface. Such a configuration provides a relatively stable configuration when placed in its expanded or use position.

The various foldable devices described herein, including stools and tables, may be formed of a variety of planar materials. Alternatively, the components of the devices may be formed of tubular materials. In addition, such components may be formed in various shapes, e.g., A-shaped, H-shaped, triangular, trapezoidal, rectangular, etc.

Figure 28:
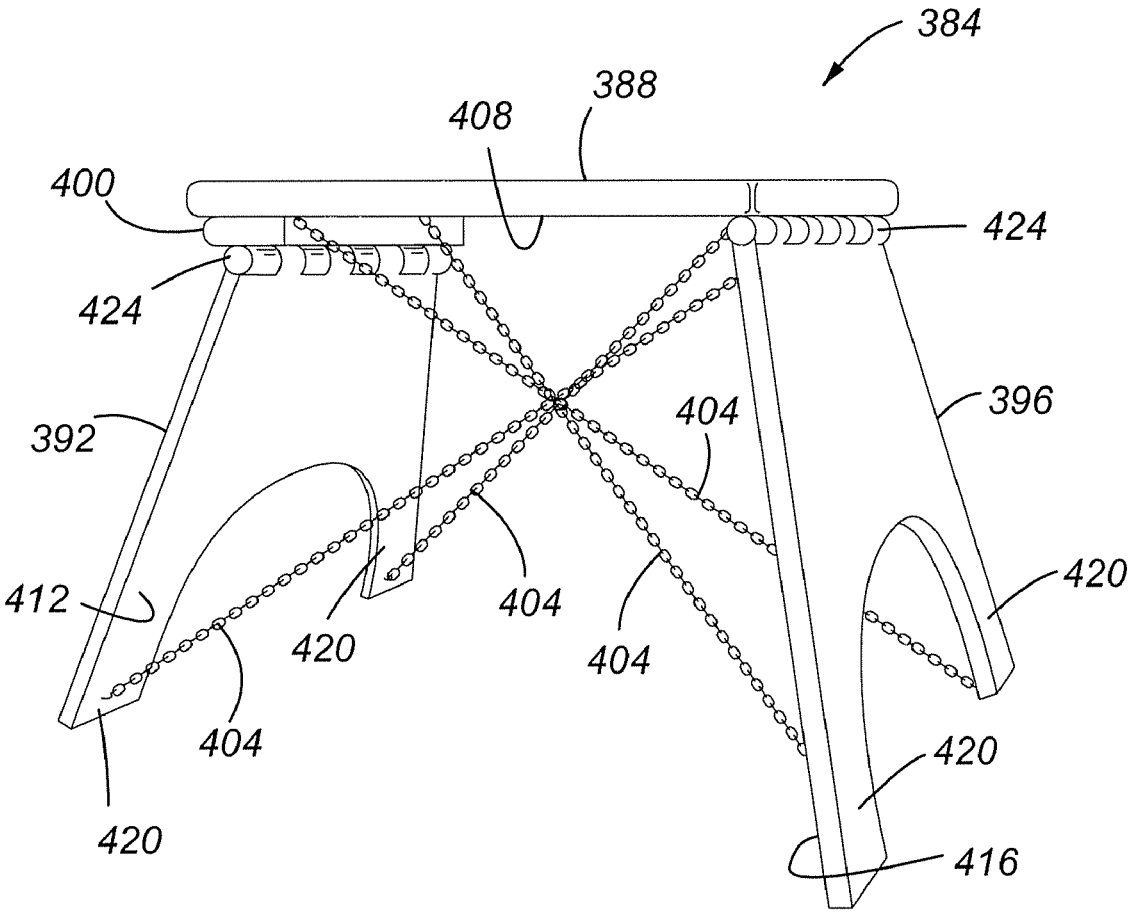
FIG. 28 is a perspective view of a further embodiment of a foldable device in accordance with embodiments of the present invention, the foldable device including tension members.
Figure 29:
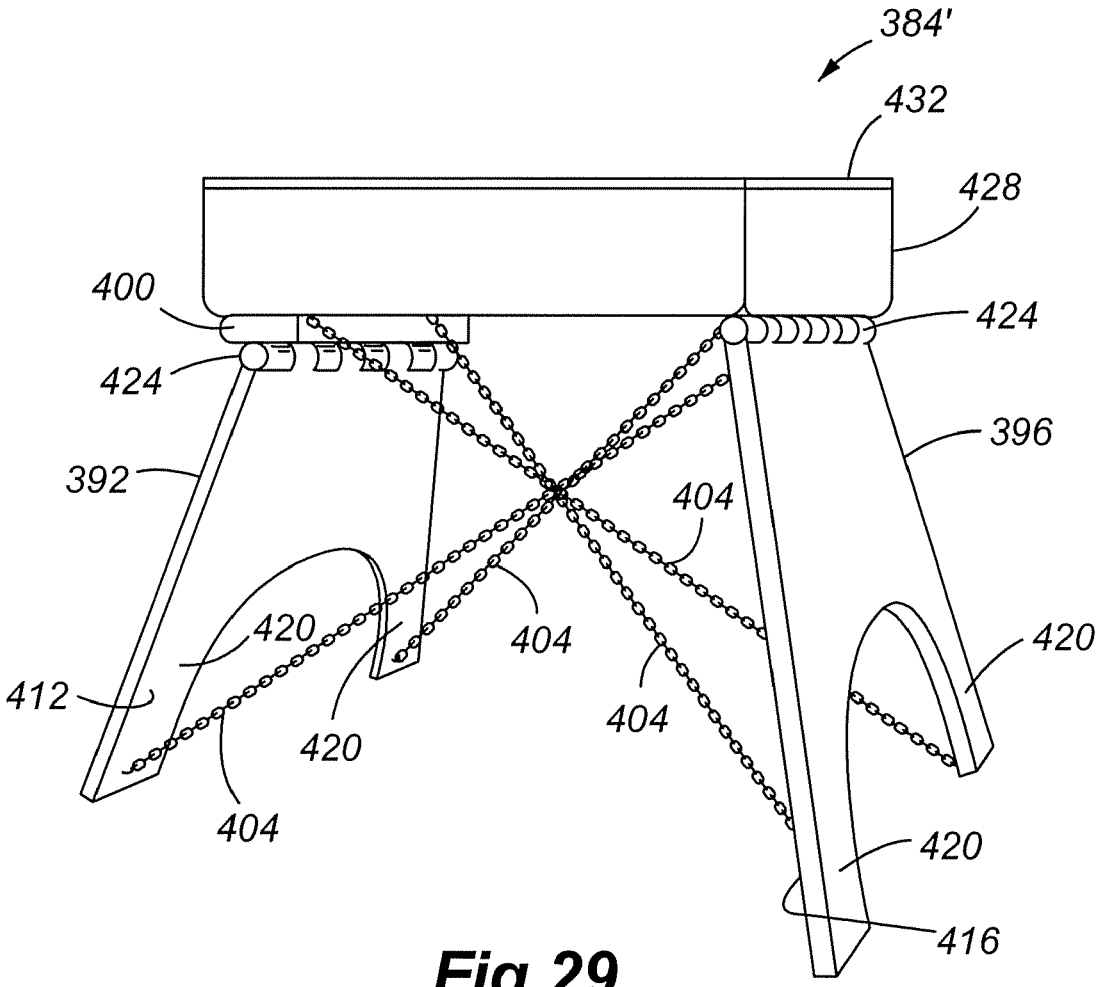
FIG. 29 is a perspective view of an alternative embodiment of the foldable device shown in FIG. 28.

In a separate aspect of the invention, various embodiments of the present invention may comprise stools and portable tables that use one or more tension members. Referring now to FIGS. 28 and 29, yet another embodiment of a foldable stool or table 384 is depicted. In this embodiment, the foldable stool or table 384 has a seat, table top or upper member 388, a first support member 392, and a second support member 396. An upper end of the first support member 392 is hingedly interconnected to a spacer block 400 that is affixed to the upper member 388. Similarly, an upper end of the second support member 396 is hingedly interconnected to the upper member 388. At least two chains or other non-elastic restraining members (e.g., rope, cable, or straps) are provided as tension members 404 and are used to limit the range of outward motion and stabilize the first and second support members 392 and 396. Thus, foldable stool or table 384 has at least two restraining elements that prevent the first and second support members 392 and 396 from moving outward, yet allow the first and second support members 392 and 396 to fold upon one another in a substantially flat position for storage. Accordingly, the first and second support members 392 and 396 can be made out of various substantially planar or tubular materials and formed in various shapes, e.g., A-shaped, H-shaped, triangular, trapezoidal, etc.

In one embodiment, two sets of tension members 404 are crisscrossed, with the first set of tension members 404 being interconnected to a bottom surface 408 of the upper member 388 and an interior surface 412 of the first support member 392, and the second set of tension members 404 being interconnected to a bottom surface 408 of the upper member 388 and an interior surface 416 of the second support member 396. In this configuration, the first and second support members 392 and 396 are prevented from rotating outwardly, thereby giving the foldable stool or table 384 stability and load carrying capacity. As a result, the foldable stool or table 384 can be made out of lighter and thinner materials than other two-legged stools that do not have any restraining members. Similar to the other embodiments described above, the foldable stool or table 384 can be made out of plastic, aluminum, fiberglass, other durable, lightweight materials, or a combination thereof.

Still referring to FIGS. 28 and 29, in alternative embodiments of the present invention, the first and second support members 392 and 396 do not have to be comprised of solid materials. Similar to the previously discussed three-legged stool 10, 10', the first and second support members 392 and 396 of the foldable stool or table 384 could be formed out of tubing, thereby creating various outlining shapes. For example, the first and second support members 392 and 396 can each be made in a flattened arch-like shape, thereby creating four legs. In this embodiment, four tension members 404 are generally crisscrossed. One end of each tension member 404 is attached to just one of the legs 420 of the first and second support members 392 and 396. The other end of each tension member 404 is attached to a bottom surface 408 of the upper member 388.

Alternatively, the first and second support members 392 and 396 can each be further comprised of a horizontal cross-tube that interconnects the first and second legs 420 of each first and second support members 392 and 396. In this embodiment, two tension members 404 are crisscrossed with one tension member 404 interconnected to the bottom surface 408 of the upper member 388 and the middle of the horizontal cross-tube of the first support member 392, and the other tension member 404 being interconnected to the bottom surface 408 of the upper member 388 and the cross-tube of the second support member 396.

In yet a further embodiment, four independent, tube-like legs could be moveably interconnected to the bottom surface 408 of the upper member 388. As previously described, four crisscrossing tension members 404 may be used to restrict the outward movement of the four legs 420 in a manner similar to that described above. Of course, it is also contemplated that just two tension members 404 could be used in the manner described above if two horizontal cross-bars were used to connect the two respective pairs of the four legs 420 of the foldable stool or table 384.

As shown in FIG. 28, the first and second support members 392 and 396 can be interconnected to the upper member 388 via piano-type hinges 424. Alternatively, other non-pinching means of moveably or rotatably interconnecting the first and second support members 392 and 396 could be used. Also, various springs or other types of biasing devices could be used in conjunction with any of these interconnections in order to facilitate the opening and closing of the first and second support members 392 and 396.

Referring now to FIG. 29, in yet another embodiment, the foldable stool or table 384' can be further comprised of a box 428 that is positioned in place of the upper member 388. The box 428 can be made with or without a lid 432 and be used for a variety of purposes, such as a tackle box, tool box, temporary storage, etc. The lid 432 may further comprise a latch (not shown) to keep it closed during transport and storage.

Figure 30:
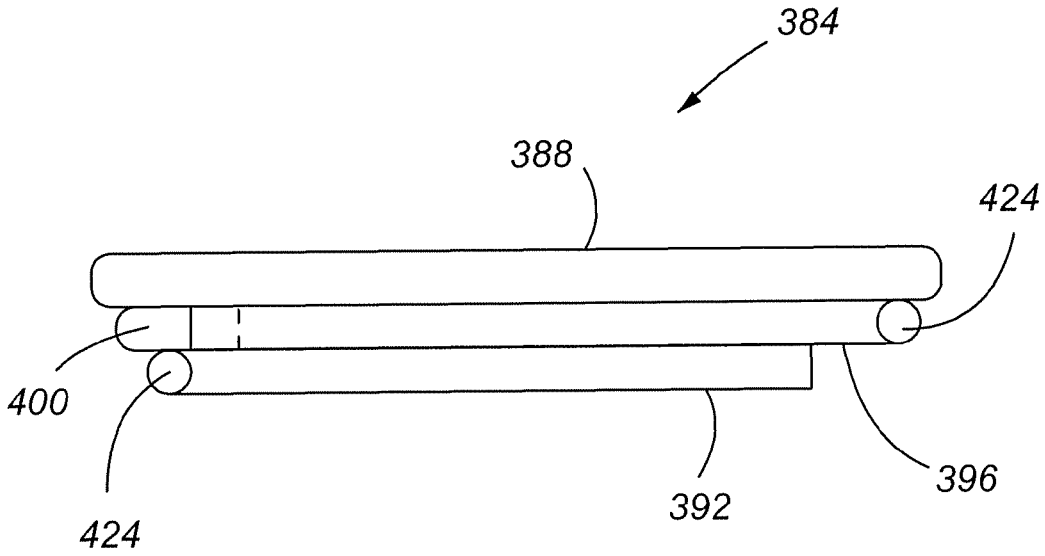
FIG. 30 is a side elevation view of the device of FIG. 28 shown in a second position of storage.

Regardless of whether or not a box 428 has replaced the upper member 388, the foldable stool or table 384, 384' has two positions—a first position of use and a second position of storage. Thus, FIGS. 28 and 29 depict the first position of use. FIG. 30 depicts the second position of storage, which is achieved by first pushing the second support member 396 toward the first support member 392, and then folding the first support member 392 over the second support member 396. The spacer block 400 should be of sufficient thickness to allow the first and second support members 392 and 396 to be folded in substantially flat, parallel positions.

Figure 31:
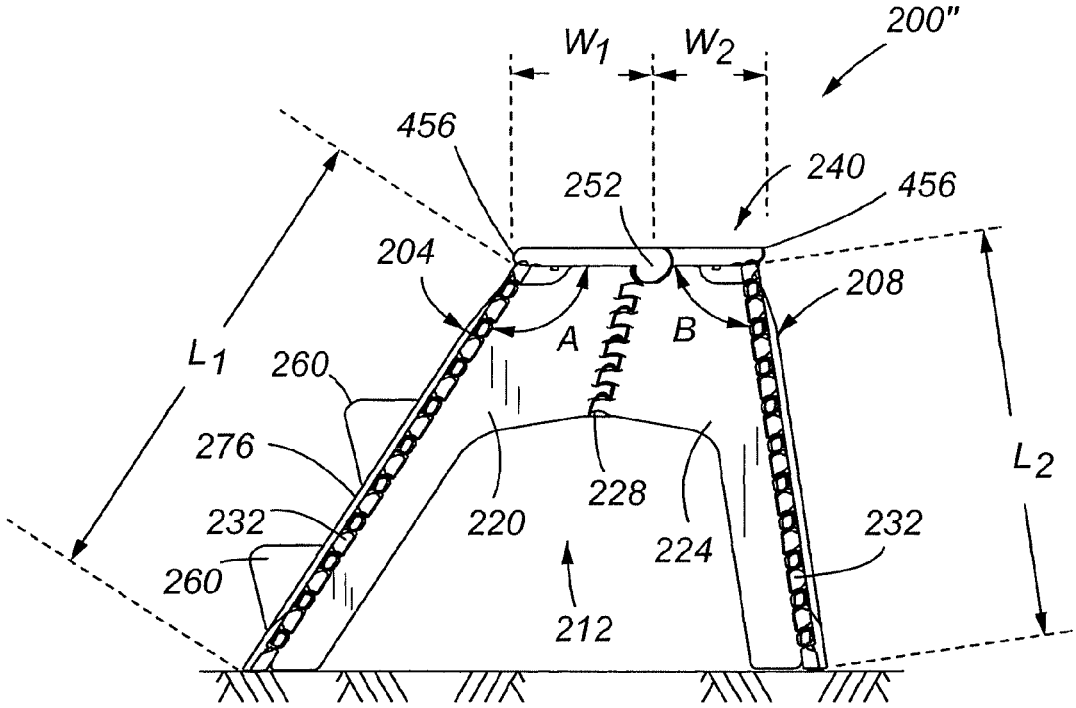
FIG. 31 is a side elevation view of an asymmetrical foldable stool in accordance with embodiments of the present invention.
Figure 32:
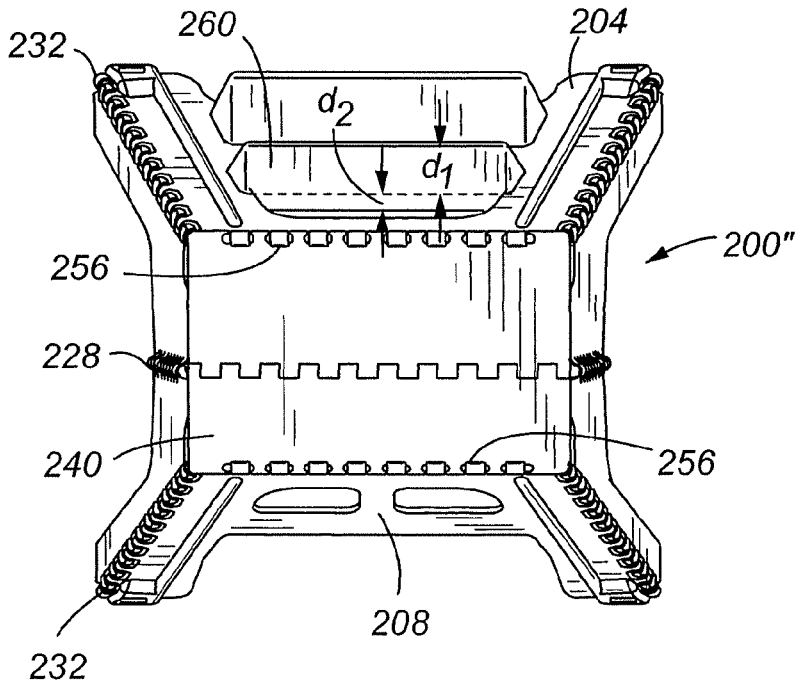
FIG. 32 is a top plan view of the foldable stool shown in FIG. 31.
Figure 33:
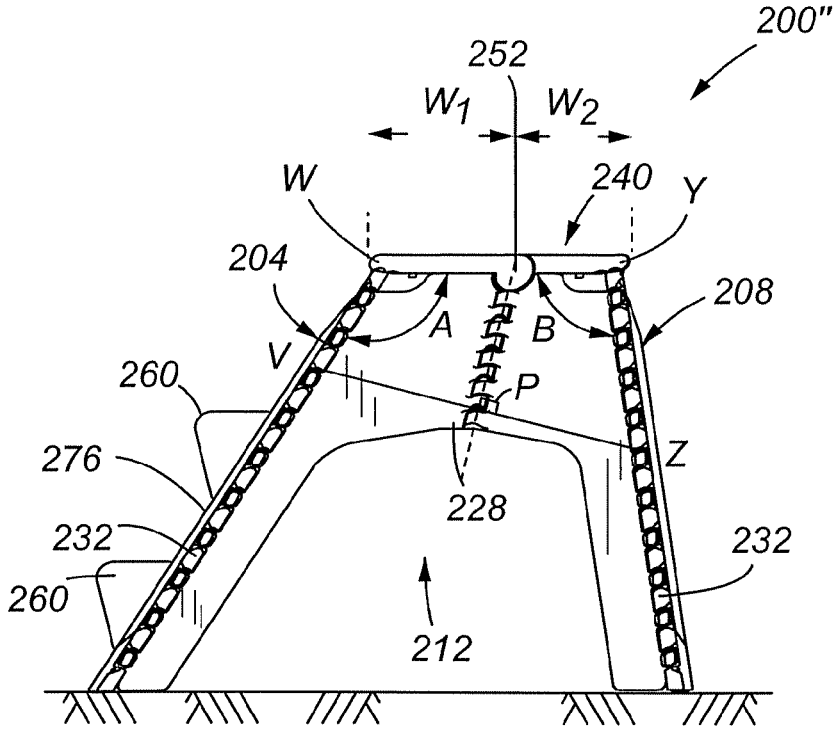
FIG. 33 is another side elevation view of the foldable stool shown in FIG. 31.

Referring now to FIGS. 31-33, another embodiment of the present invention is shown comprising an asymmetrical folding stool 200". In this embodiment, the angle A between the first non-folding support member 204 and the upper member 240 is greater than the angle B between the second non-folding support member 208 and the upper member 240, thus creating an asymmetrical configuration when viewed in profile (as shown in FIG. 31). Stool 200" may include a variety of features of the stool 200, including one or more steps 260, and may further comprise an aperture 254 to provide a handle for carrying the stool 200".

Referring in detail now to FIG. 31, a distance $L_1$ defined by the length of the first non-folding support member 204 measured from the underlying surface to the upper member 240 is greater than a distance $L_2$ defined by the length of the second non-folding support member 208 measured from the underlying surface to the upper member 240. In addition, a first distance $W_1$ from the front edge 452 of the upper member 240 to the upper hinge 252 is greater than a second distance $W_2$ between the upper hinge 252 to the back edge 456 of the upper member 240. In addition, the asymmetry of the stool 200" causes the axis of the hinge 228 to be non-perpendicular to the upper member 240 when the stool 200" is in the use position. The upper hinge 252 is offset from center of the upper member 240, given the relationship of $W_1$ being greater than $W_2$.

Referring to FIG. 32, the ratio of the front depth d1 to the back depth d2 of step 260 (that is, d1÷d2 as discussed previously with attention to FIG. 10) is such that the step 260 is eccentrically positioned relative to the front surface 276 of the first non-folding support member 204. This advantageously allows the stool 200" to be folded into a thinner profile while at the same time creating a more accessible stepping platform for the user to ascend and descend during use. This embodiment allows the stool 200" to be positioned closer to a wall or other vertical surface for ease of access to the wall or vertical surface.

Referring now to FIG. 33 for this particular embodiment, a line intersecting the axis of the hinge 228, which is perpendicular to the axis of the hinge 228 (for example, the line as shown in FIG. 33 as line VZ), exhibits certain geometric characteristics. In particular, the distance from the axis of the hinge 228 to the first non-folding support member 204, as shown in FIG. 33 as line PV, is equal to the distance from the axis of the hinge 228 to the second non-folding support member 208, as shown in FIG. 33 as line PZ. The sum of the distance VW from point V to the center W of upper edge hinge 256 (not shown) between first non-folding support member and upper member 240 and $W_1$ is equal to the sum of $W_2$ and the distance YZ from the center Y of upper edge hinge 256 (not shown) between second non-folding support member and upper member 240 to point Z (that is, $VW+W_1=W_2+YZ$). These geometric relationships hold true for any straight line which is perpendicular to the axis of the hinge 228 and which intersects both the first non-folding member 204 and the second non-folding member 208. In this embodiment, the point at which the axis of the hinge 228 meets the upper member 240 and location of the axis of the upper hinge 252 are necessarily in close proximity to enable the stool to collapse from a use position to a stowed position and still allow the first non-folding member 204 and the second non-folding member 208 to be hingedly attached to the first upper portion 244 and the second upper portion 248.

Figure 34:
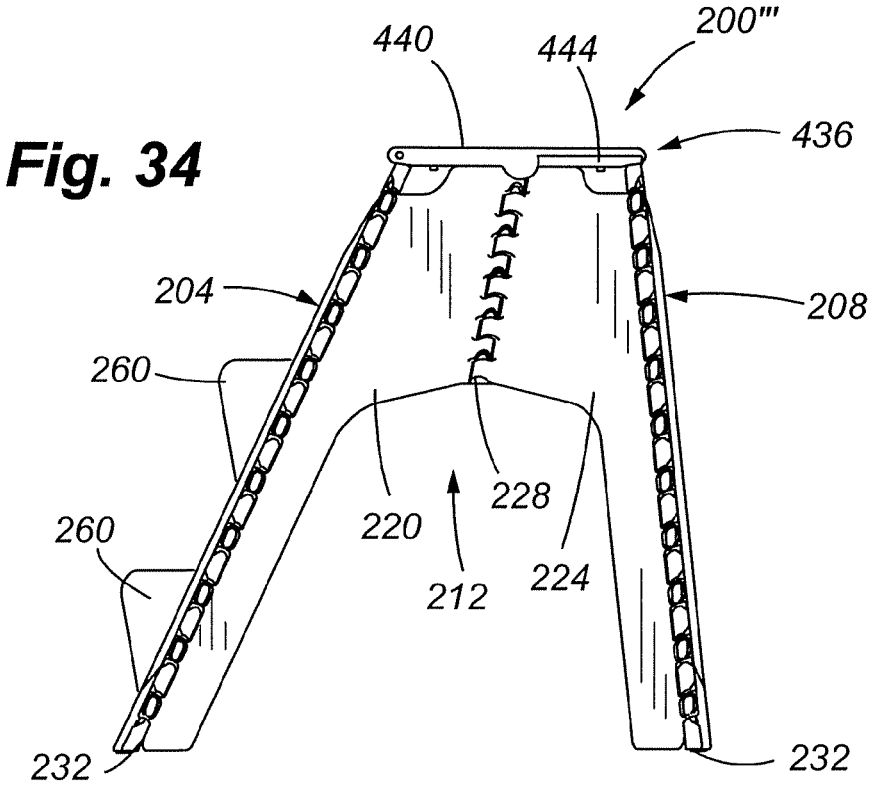
FIG. 34 is a side elevation view of another asymmetrical foldable stool in accordance with embodiments of the present invention.
Figure 35:
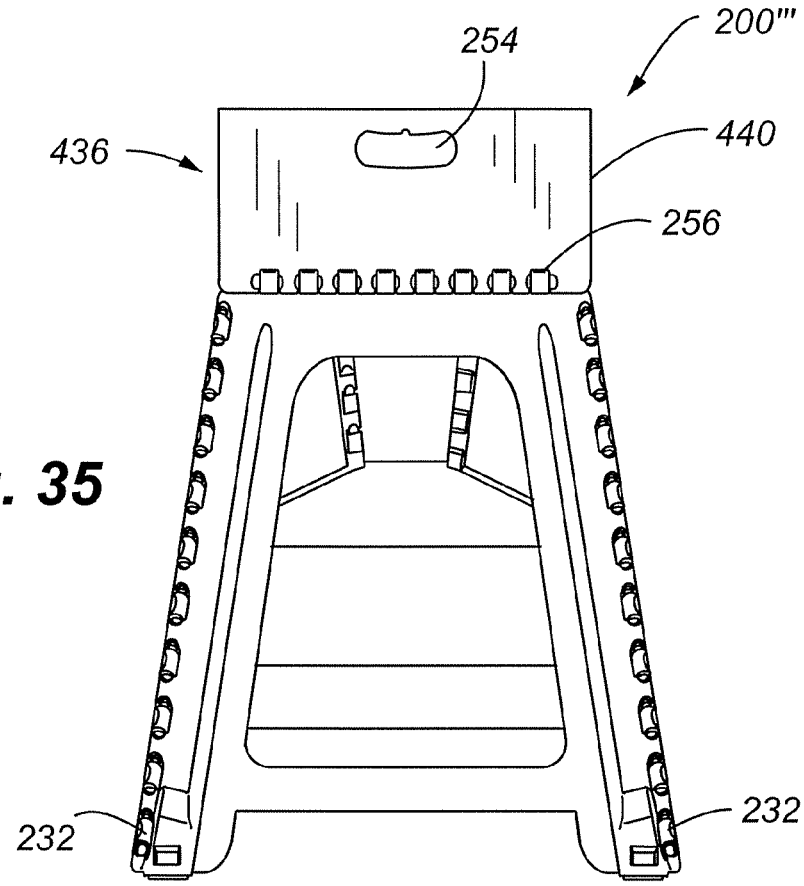
FIG. 35 is a front elevation view of the foldable stool shown in FIG. 34 in its collapsed or folded storage position.
Figure 36:
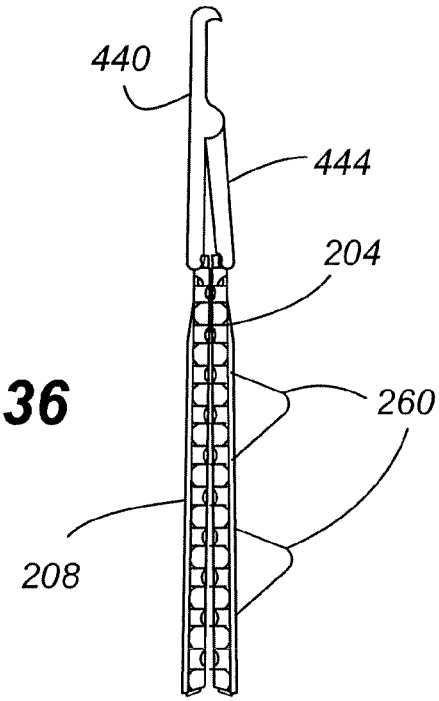
FIG. 36 is a side elevation view of the collapsed foldable stool shown in FIG. 35.

Referring now to FIGS. 34-36, another embodiment of the present invention is shown comprising an asymmetrical folding stool 200''' having an upper member 436 with a one-piece upper portion 440 that at least partially overlaps a hingedly interconnected underlying portion 444. The continuous one-piece upper portion 440 provides additional strength to the upper member 436. In this embodiment, at least one step 260 may be provided that is eccentrically positioned relative to the front surface 276 of the first non-folding support member 204. In addition, although different in configuration, the one-piece upper portion 440 may comprise an aperture 254 to provide a handle for carrying the stool 200'''.

By way of example and not by limitation, and in accordance with this embodiment, the stool 200''' is comprised of a one-piece upper portion 440 that measures approximately 14 inches along its major axis (from the side adjacent the first folding support member 212 to the side adjacent the second folding support member 216 when the stool is in its use position) and measures approximately 10 inches along its minor axis (from the side adjacent the first non-folding support 204 member to the side adjacent the second non-folding support member 208 when the stool is in its use position). While in its use position, the stool 200''' measures approximately 24 inches tall, and while in its stowed position measures approximately 34 inches tall.

The following components and numbers associated thereto are provided for clarity purposes:

| # | Component |
|---|---|
| 10, 10' | Foldable Stool |
| 14 | Seat |
| 18 | First Support Member |
| 22 | Second Support Member |
| 26 | Third Support Member |
| 30 | First Portion (of Seat 14) |
| 34 | Second Portion (of Seat 14) |
| 36 | Hinge |
| 38 | Top Side (of First Support Member 18) |
| 42 | Bottom Side (of First Support Member 18) |
| 46 | First Lateral Edge (of First Support Member 18) |
| 50 | Second Lateral Edge (of First Support Member 18) |
| 54 | Top Side (of Second Support Member 22) |
| 58 | Bottom Side (of Second Support Member 22) |
| 62 | First Lateral Edge (of Second Support Member 22) |
| 66 | Second Lateral Edge (of Second Support Member 22) |
| 70 | First Lateral Portion (of Third Support Member 26) |
| 74 | Second Lateral Portion (of Third Support Member 26) |
| 78 | Bottom Surface (of First Portion 30 of Seat 14) |
| 82 | Bottom Surface (of Second Portion 34 of Seat 14) |
| 86 | Aperture |
| 90 | Arch Structure |
| 94 | Aperture |
| 98 | Horizontal Lower Edge |

-continued

| # | Component |
|---|---|
| 102 | Step |
| 204 | First Non-Folding Support Member |
| 208 | Second Non-Folding Support Member |
| 212 | First Folding Support Member |
| 216 | Second Folding Support Member |
| 220 | First Lateral Portion (of First or Second Folding Support Members 212 and 216) |
| 224 | Second Lateral Portion (of First or Second Folding Support Members 212 and 216) |
| 228 | Hinge |
| 232 | Corner Hinge |
| 244 | First Upper Portion (of Upper Member 240) |
| 248 | Second Upper Portion (of Upper Member 240) |
| 252 | Upper Hinge |
| 256 | Upper Edge Hinge |
| 258 | Upper Surface (of Upper Hinge Member 240) |
| 260, 260a, 260b, 260c | Step |
| 264 | Upper Surface (of Step 260) |
| 268 | Front Edge (of Step 260) |
| 272 | Back Edge (of Step 260) |
| 276 | Front Surface (of First Non-Folding Support Member 204) |
| 280 | Step Top Angle |
| 284 | Step Bottom Angle |
| 288 | Step Return Surface |
| 292 | Step Exterior Angle |
| 296 | Openings (in Second Non-Folding Support Member 208) |
| 300 | Vertical Section (between Openings 296) |
| 304 | Legs (of Non-Folding Support Members 204 and 208) |
| 308 | Plug |
| 312 | Bearing Surface (of Plug 308) |
| 316 | Receptacles (in Legs 304 for Plugs 308) |
| 320 | Window (in Receptacle 316) |
| 324 | Projection |
| 328 | Upper Surface (of First and Second Lateral Portions 220 and 224) |
| 332 | Receptacle (for Projection 324) |
| 336 | Upper Member |
| 340 | One-Piece Upper Portion (of Upper Member 336) |
| 344 | Underlying Portion (of Upper Member 336) |
| 348 | Stool |
| 352 | Folding Table |
| 356 | Oversized Upper Member |
| 360 | Shelf |
| 364 | Cup Holder |
| 368 | Foldable Table |
| 372 | Opening |
| 376 | Foldable Table |
| 380 | Foldable Table |
| 384, 384' | Foldable Stool or Table |
| 388 | Upper Member |
| 392 | First Support Member |
| 396 | Second Support Member |
| 400 | Spacer Block |
| 404 | Tension Member |
| 408 | Bottom Surface (of Upper Member 388) |
| 412 | Inside Surface (of First Support Member 392) |
| 416 | Inside Surface (of Second Support Member 396) |
| 420 | Leg |
| 428 | Box |
| 432 | Lid |
| 436 | Upper Member of Stool 200''' |
| 440 | One-Piece Upper Portion (of Upper Member 436 of Stool 200''') |
| 444 | Underlying Portion (of Upper Member 436 of Stool 200''') |
| 452 | Front Edge (of Upper Member 240) |
| 456 | Back Edge (of Upper Member 240) |
| A | Angle between the first non-folding support member 204 and the upper member 240 |
| B | Angle between the second non-folding support member 208 and the upper member 240 |
| D | Step Depth |
| d1 | Front Depth (of Step 260) |
| d2 | Back Depth (of Step 260) |
| H | Height of Support Member |

-continued

| # | Component |
|---|---|
| L1 | Length (of First Non-Folding Support Member 204 of Stool 200'') |
| L2 | Length (of Second Non-Folding Support Member 204 of Stool 200'') |
| W1 | Width (of Upper Member 240 from the Front Edge 452 to the Upper Hinge 252 of Stool 200'') |
| W2 | Width (of Upper Member 240 from the Back Edge 456 to the Upper Hinge 252 of Stool 200'') |
| P | Point where line between V and Z and perpendicular to axis of Hinge 228 intersects axis of Hinge 228 |
| V | Point where line perpendicular to axis of Hinge 228 intersects First Non-Folding Support Member 204 |
| W | Center of Upper Edge Hinge 256 between First Non-Folding Support Member and Upper Member 240 (of Stool 200'') |
| Y | Center of Upper Edge Hinge 256 between Second Non-Folding Support Member and Upper Member 240 (of Stool 200'') |
| Z | Point where line perpendicular to axis of Hinge 228 intersects Second Non-Folding Support Member 208 |

A number of variations and modifications of the invention can be used. It would be possible to provide for some features of the invention without providing others. For example, in one alternative embodiment, a portable table may be provide with an upper member not subdivided into first and second portions. In another alternative embodiment, three-legged stool may comprise an eccentrically positioned built-in step.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights that include alternative embodiments to the extent permitted, including alternate, interchangeable and/or equivalent structures, functions, ranges or steps to those claimed.

What is claimed is:

1. A foldable stool, comprising:

an upper member including a first upper portion operably interconnected to a second upper portion, said first upper portion and said second upper portion each having an outer edge;

a first non-folding support member having an upper edge, a bottom edge, a left lateral edge and a right lateral edge wherein said upper edge is operably interconnected to said outer edge of said first upper portion, said first non-folding support member comprising at least one integrally-molded step;

a second non-folding support member having an upper edge, a bottom edge, a left lateral edge and a right lateral edge wherein said upper edge is operably interconnected to said outer edge of said second upper portion; and a first folding support member and a second folding support member, each comprising a first lateral portion that is operably interconnected to a second lateral portion, wherein:

said first lateral portion of said first folding support member is operably interconnected to said right lateral edge of said first non-folding support member;

said first lateral portion of said second folding support member is operably interconnected to said right lateral edge of said second non-folding support member;

said second lateral portion of said first folding support member is operably interconnected to said left lateral edge of said second non-folding support member; and said second lateral portion of said second folding support member is operably interconnected to said left lateral edge of said first non-folding support member.

2. The foldable stool of claim 1, wherein said second non-folding support member comprises at least one step.

3. The foldable stool of claim 1, wherein the total thickness of said stool in a folded position is no greater than about 4.5 inches, said folded position comprising:

wherein said first lateral portion and said second lateral portion of said first folding support member are folded such that an outer surface of said first lateral portion and an outer surface of said second lateral portion are positioned adjacent to each other;

wherein said first lateral portion and said second lateral portion of said second folding support member are folded such that an outer surface of said first lateral portion and an outer surface of said second lateral portion are positioned adjacent to each other; and wherein an inner surface of said first upper portion and an inner surface of said second upper portion are positioned adjacent to each other.

4. The foldable stool of claim 3, wherein a handle is formed when said stool is in said folded position, said handle comprising opposing apertures in said first upper portion and said second upper portion.

5. A collapsible stool for placement on a substantially horizontal underlying surface, comprising:

an upper member including a first upper portion hingedly interconnected to a second upper portion, said first upper portion having an outer edge and said second upper portion having an outer edge, and wherein said first upper portion and said second upper portion form a generally horizontal surface in a first position of use;

a first non-folding support member having an upper edge hingedly interconnected to said outer edge of said first upper portion, said first non-folding support member comprising at least one step or shelf;

a second non-folding support member having an upper edge hingedly interconnected to said outer edge of said second upper portion;

a first folding support member having lateral edges that are hingedly interconnected to lateral edges of said first non-folding support member and said second non-folding support member;

a second folding support member having lateral edges that are hingedly interconnected to lateral edges of said first non-folding support member and said second non-folding support member; and wherein said stool is collapsible from said first position of use, where the first and second non-folding support members are positioned apart, to a second position of storage, where the first non-folding support member and the second non-folding support member are positioned adjacent to each other.

6. The collapsible stool of claim 5, wherein said first folding support member and said second folding support member comprise first and second lateral portions, wherein:

said first lateral portion of said first folding support member is hingedly interconnected to said right lateral edge of said first non-folding support member;

said first lateral portion of said second folding support member is hingedly interconnected to said right lateral edge of said second non-folding support member;

said second lateral portion of said first folding support member is hingedly interconnected to said left lateral edge of said second non-folding support member; and second lateral portion of said second folding support member is hingedly interconnected to said left lateral edge of said first non-folding support member.

7. The collapsible stool of claim 5, wherein said upper member comprises a surface area generally equal to an area defined by said upper edge of said first non-folding support member, said upper edge of said second non-folding support member and upper edges of said first folding support member and said second folding member.

8. The collapsible stool of claim 5, wherein said upper member comprises a surface area greater than an area defined by said upper edge of said first non-folding support member, said upper edge of said second non-folding support member and upper edges of said first folding support member and said second folding member.

9. The collapsible stool of claim 8, wherein said first upper portion and said second upper portion form a table in said first position of use.

10. The collapsible stool of claim 5, wherein said upper member, said first and second non-folding support members, and said first and second folding support members are comprised of a plastic material.

11. The collapsible stool of claim 5, wherein said at least one step or shelf is about 1 to 8 inches deep.

12. The collapsible stool of claim 5, wherein said second non-folding support member includes at least one step or shelf.

13. The collapsible stool of claim 5, wherein said first non-folding support member includes two steps and said second non-folding support member includes one step.

14. A foldable stool that is selectively collapsible from a position of use to a position of storage, comprising:

an upper member including a first upper portion rotatably interconnected to a second upper portion, said first upper portion and said second upper portion each having an outer edge;

a first non-folding support member rotatably interconnected on an upper end to said outer edge of said first upper portion, said first non-folding support member having at least one step;

a second non-folding support member rotatably interconnected on an upper end to said outer edge of said second upper portion, said second non-folding support member having at least one step; and a first folding support member and a second folding support member comprising rotatably interconnected first lateral and second lateral portions, wherein:

said first lateral portion of said first folding support member is rotatably interconnected on a left side to said first non-folding support member;

said first lateral portion of said second folding support member is rotatably interconnected on a right side to said first non-folding support member;

said second lateral portion of said first folding support member is rotatably interconnected on a right side to said second non-folding support member;

said second lateral portion of said second folding support member is rotatably interconnected on a left side to said second non-folding support member.

15. The foldable stool of claim 14, wherein said first upper portion at least partially overlaps said second upper portion when said stool is in said position of use.

16. The foldable stool of claim 14, wherein said first upper portion completely overlaps said second upper portion when said stool is in said position of use.

17. The foldable stool of claim 14, wherein said first non-folding support member includes two steps.

* * * * *